US008157588B1

(12) United States Patent
Rodrigues et al.

(10) Patent No.: US 8,157,588 B1
(45) Date of Patent: Apr. 17, 2012

(54) CABLE CONNECTOR WITH BIASING ELEMENT

(75) Inventors: Julio F. Rodrigues, Collierville, TN (US); Joey D. Magno, Jr., Cordova, TN (US); Roger Phillips, Jr., Horseheads, NY (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/023,102

(22) Filed: Feb. 8, 2011

(51) Int. Cl.
*H01R 13/62* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 2,795,144 | A | 6/1957 | Morse | |
| 3,471,158 | A | 10/1969 | Solins | |
| 3,498,647 | A | 3/1970 | Schroder | |
| 4,156,554 | A | 5/1979 | Aujla | |
| 4,340,269 | A | 7/1982 | McGeary | |
| 4,557,654 | A | 12/1985 | Masuda et al. | |
| 4,674,818 | A | 6/1987 | McMills et al. | |
| 4,702,710 | A | 10/1987 | Dittman et al. | |
| 4,869,679 | A | 9/1989 | Szegda | |
| 4,887,950 | A | 12/1989 | Sakayori et al. | |
| 4,897,008 | A | 1/1990 | Parks | |
| 5,059,139 | A | 10/1991 | Spinner | |
| 5,586,910 | A | 12/1996 | Del Negro et al. | |
| 5,857,865 | A | 1/1999 | Shimirak et al. | |
| 6,716,062 | B1 * | 4/2004 | Palinkas et al. | 439/578 |
| 6,929,265 | B2 | 8/2005 | Holland et al. | |
| 7,097,500 | B2 | 8/2006 | Montena | |
| 7,118,416 | B2 | 10/2006 | Montena et al. | |
| 7,172,380 | B2 | 2/2007 | Lees et al. | |
| 7,172,381 | B2 | 2/2007 | Miyazaki | |
| 7,186,127 | B2 | 3/2007 | Montena | |
| 7,264,503 | B2 | 9/2007 | Montena | |
| 7,354,309 | B2 | 4/2008 | Palinkas | |
| 7,402,063 | B2 | 7/2008 | Montena | |
| 7,500,874 | B2 | 3/2009 | Montena | |
| 7,513,795 | B1 | 4/2009 | Shaw | |
| 7,544,094 | B1 | 6/2009 | Paglia et al. | |
| 7,544,097 | B2 | 6/2009 | Hong et al. | |
| 7,566,236 | B2 * | 7/2009 | Malloy et al. | 439/321 |
| D597,959 | S | 8/2009 | Malloy | |
| 7,661,984 | B2 | 2/2010 | McMullen et al. | |
| 2004/0077215 | A1 * | 4/2004 | Palinkas et al. | 439/578 |
| 2010/0081321 | A1 * | 4/2010 | Malloy et al. | 439/578 |
| 2011/0117774 | A1 * | 5/2011 | Malloy et al. | 439/578 |

FOREIGN PATENT DOCUMENTS

| | | | |
|---|---|---|---|
| WO | 2010054021 | A2 | 5/2010 |
| WO | 2010054026 | A2 | 5/2010 |

* cited by examiner

*Primary Examiner* — Gary F. Paumen
(74) *Attorney, Agent, or Firm* — Foley & Lardner LLP

(57) ABSTRACT

A coaxial cable connector for coupling a coaxial cable to a mating connector is disclosed. The coaxial cable connector may include a connector body having a forward end and a rearward cable receiving end for receiving a cable. The connector may include a nut rotatably coupled to the forward end of the connector body and an annular post disposed within the connector body for providing an electrical path between the mating connector and the coaxial cable. The connector may include a biasing element, wherein the biasing element is configured to provide a force to maintain the electrical path between the mating connector and the coaxial cable. In one embodiment, the biasing element is external to the nut and the connector body. In one embodiment, the biasing element surrounds a portion of the nut and/or the connector body.

21 Claims, 31 Drawing Sheets

CABLE CONNECTOR WITH BIASING ELEMENT

BACKGROUND OF THE INVENTION

Embodiments disclosed herein relate to cable connectors and, in some cases, coaxial cable connectors. Such connectors are used to connect coaxial cables to various electronic devices, such as televisions, antennas, set-top boxes, satellite television receivers, etc. A coaxial cable connector may include a connector body for accommodating a coaxial cable, and a nut coupled to the body to mechanically attach the connector to an external device.

The Society of Cable Telecommunication Engineers (SCTE) provides values for the amount of torque recommended for connecting coaxial cable connectors to various external devices. Indeed, many cable television (CATV) providers, for example, also require installers to apply a torque of 25 to 30 in/lb to secure the fittings. The torque requirement prevents loss of signals (egress) or introduction of unwanted signals (ingress) between the two mating surfaces of the male and female connectors, known in the field as the reference plane.

DETAILED DESCRIPTION OF THE PREFERRED EMBODIMENTS

A large number of home coaxial cable installations are often done by "do-it yourself" laypersons who may not be familiar with SCTE torque standards. In these cases, the installer may tighten the coaxial cable connectors by hand instead of using a tool, which may result in the connectors not being properly seated, either upon initial installation, or after a period of use. Upon receiving a poor signal, the customer may call the CATV, MSO, satellite or telecommunication provider to request repair service. Such calls may create a cost for the CATV, MSO, satellite and telecommunication providers, who may send a repair technician to the customer's home.

Moreover, even when tightened according to the proper torque requirements, prior art connectors may tend, over time, to disconnect from the external device due to forces, such as vibrations, thermal expansion and contraction, etc. Specifically, the internally threaded nut that provides mechanical attachment of the connector to an external device may back-off or loosen from the threaded port connector of the external device over time. Once the connector becomes sufficiently loosened, electrical contact between the coaxial cable and the external device is broken, resulting in a poor connection.

Figure 1A:
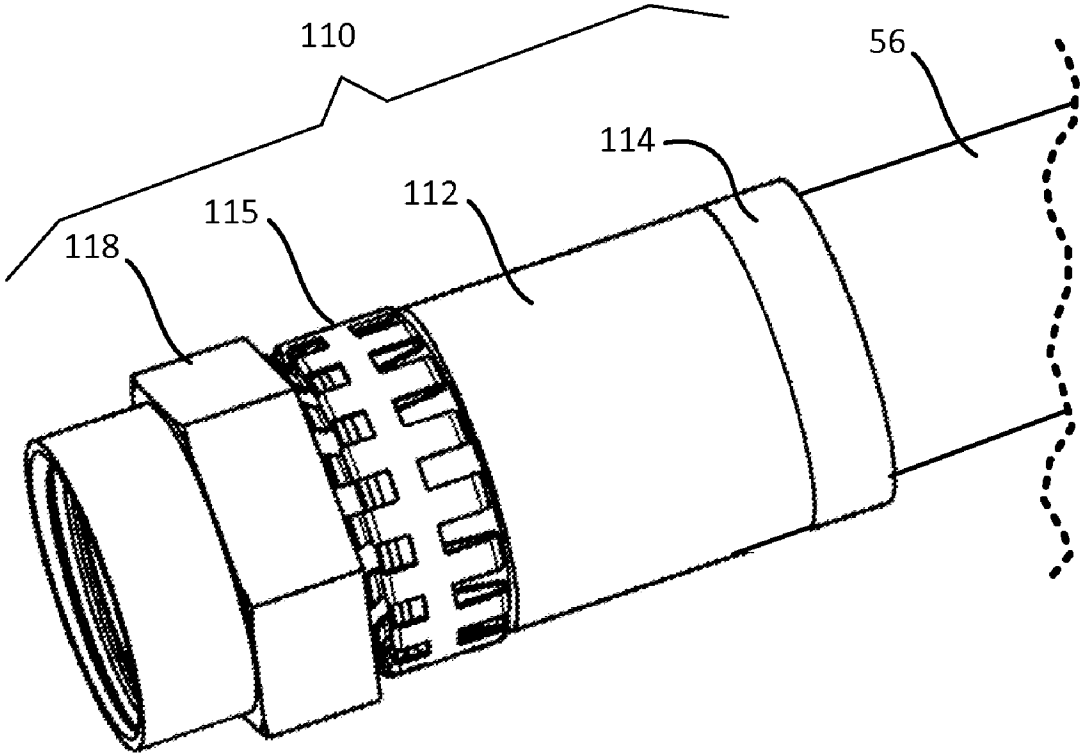
FIG. 1A is a perspective drawing of an exemplary coaxial cable connector in an assembled configuration with a biasing element.

FIG. 1A is a perspective drawing of an exemplary coaxial cable connector 110 in an assembled configuration and attached to the end of a coaxial cable 56. As illustrated in FIG. 1A, connector 110 may include a connector body 112, a locking sleeve 114, a rotatable nut 118, and a biasing element 115. In embodiments described below, connector 110 may be fastened to a port (not shown) of an electrical device (e.g. a television). Biasing element 115 may provide tension to reduce the chance of nut 118 becoming loose or backing off the port. Biasing element 115 may also reduce the chance of breaking the electrical continuity of the ground and/or shield connection between the port and the coaxial cable. As discussed below, biasing element 115 may be implemented in different ways.

Figure 1B:
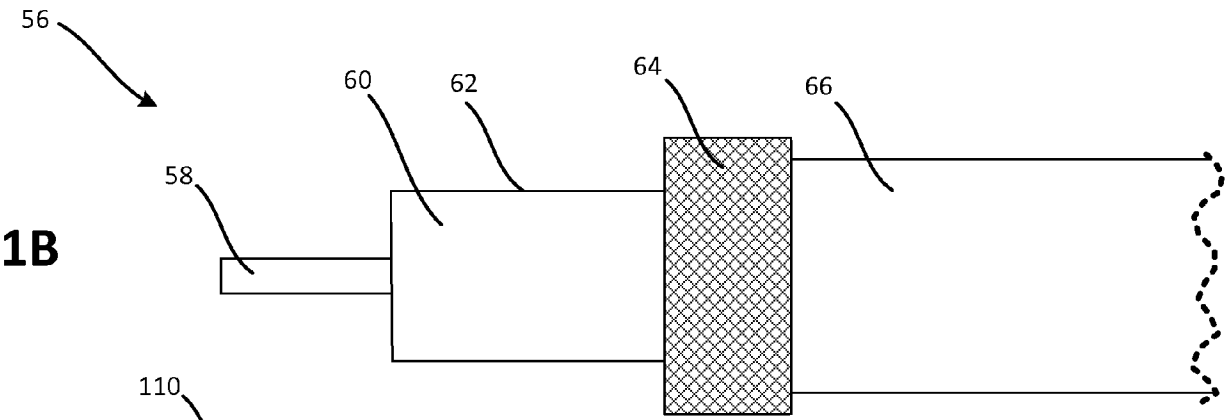
FIG. 1B is a drawing of a coaxial cable having been prepared to be inserted into and terminated by a coaxial cable connector, such as the coaxial cable connector of FIG. 1.

FIG. 1B is a drawing of coaxial cable 56 that has been prepared to be inserted into and terminated by a coaxial cable connector, such as connector 110. Coaxial cable 56 includes a center conductor 58 surrounded by a dielectric covering 60. Dielectric covering 60 is surrounded by a foil 62 and a metallic braid 64. Braid 64 is covered by an outer covering or jacket 66, which may be plastic or any other insulating material. To prepare coaxial cable 56 for use with a coaxial cable connector, cable 56 may be stripped using a wire stripper. As shown in FIG. 1B, a portion of center conductor 58 is exposed by removing a portion of the dielectric covering 60. Foil 62 may remain covering the dielectric layer 60. Metallic braid 64 may then be folded back over onto jacket 66 to overlap with jacket 66. The overlapping portion of metallic braid 64 may extend partially up the length of jacket 66.

Figure 1C:
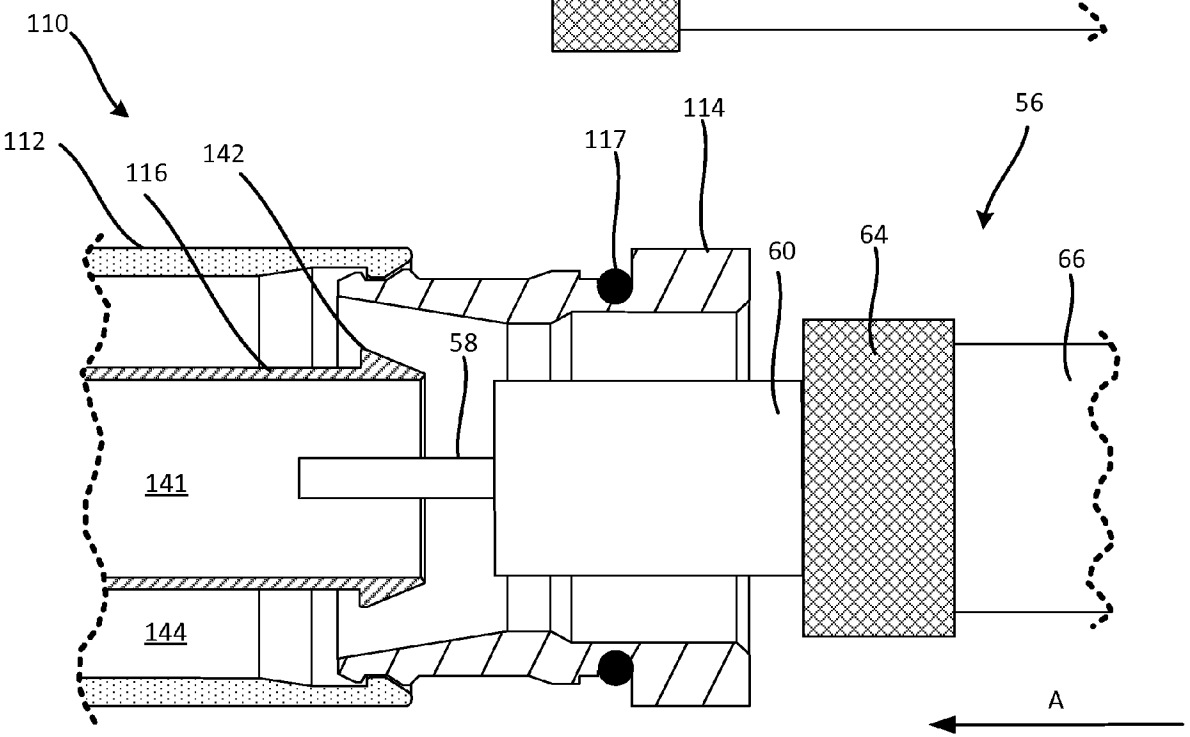
FIG. 1C is a cross-sectional drawing of an exemplary rear portion of the coaxial cable connector of FIG. 1A in an unattached configuration.

FIG. 1C is a cross-sectional drawing of an exemplary rear portion of coaxial cable connector 110 in an unattached configuration. As shown in FIG. 1C, in addition to body 112 and locking sleeve 114, connector 110 may include a post 116. FIG. 1C also shows a coaxial cable 56 being inserted into connector 110, e.g., moved forward in the direction of arrow A. Post 116 may include an annular barb 142 (e.g., a radially, outwardly extending ramped flange portion) that, as cable 56 is moved forward, is forced between dielectric layer 60 and braid 64. Barb 142 may also facilitate expansion of jacket 66 of cable 56. Locking sleeve 114 may then be moved forward (e.g., in direction A) into connector body 112 to clamp cable jacket 66 against barb 142, providing cable retention. In one embodiment, o-ring 117 may form a seal (e.g., a water-tight seal) between locking sleeve 114 and connector body 112.

Figure 1D:
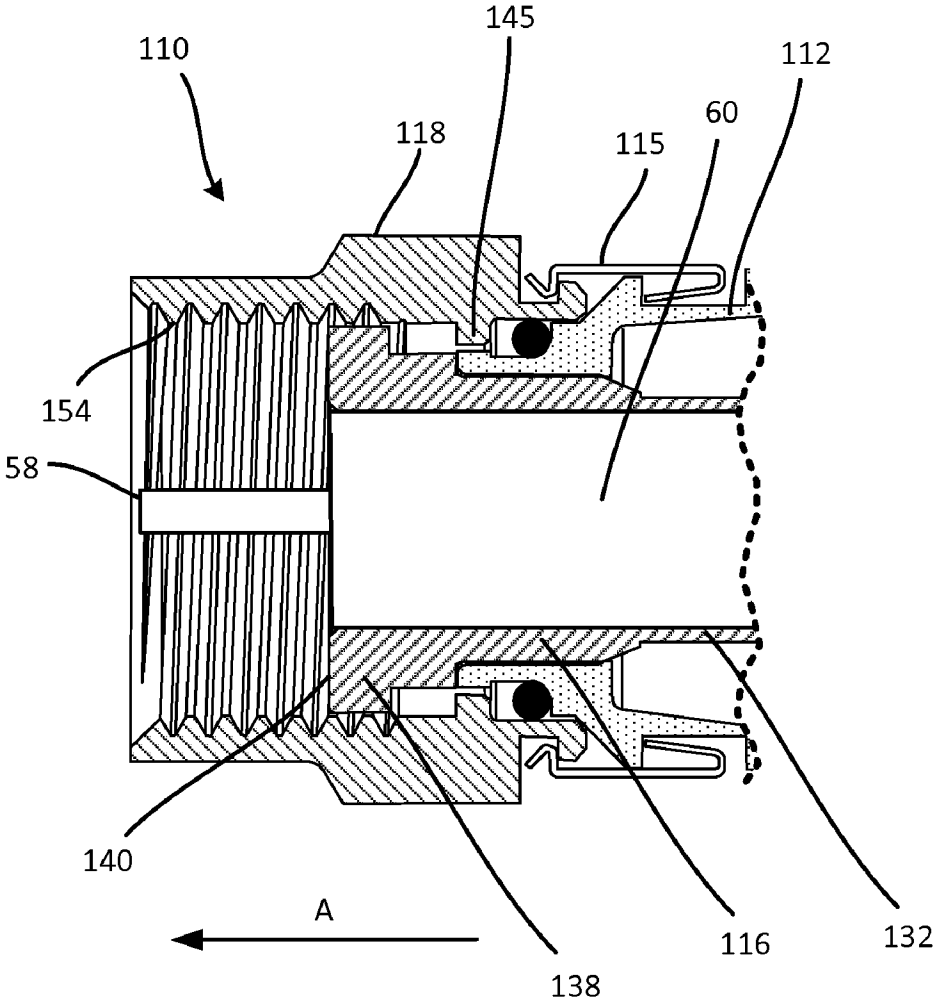
FIG. 1D is a cross-sectional drawings of an exemplary forward portion of the coaxial cable connector of FIG. 1A in which the coaxial cable of FIG. 1B has been secured.

FIG. 1D is a cross-sectional drawing of an exemplary forward portion of coaxial cable connector 110 in which coaxial cable 56 has been secured. FIG. 1D shows cross sections of rotatable nut 118, connector body 112, and tubular post 116 so as to reveal coaxial cable 56 (e.g., dielectric covering 60 and center conductor 58 of coaxial cable 56 are exposed for viewing). Post 116 may include a flanged portion 138 at its forward end. Post 116 may also include an annular tubular extension 132 that extends rearwardly. Post 116 defines a chamber that may receive center conductor 58 and dielectric covering 60 of an inserted coaxial cable 56. The external surface of post 116 may be secured into body 112 with an interference fit. Tubular extension 132 of post 116 may extend rearwardly within body 112. Post 116 may secure nut 118 by capturing an inwardly protruding flange 145 of nut 118 between body 112 and flanged portion 138 of post 116. In the configuration shown in FIG. 1D, nut 118 may be rotatably secured to post 116 and connector body 112. As shown in FIG. 1D, in one embodiment, an O-ring may be positioned between nut 118 and body 112. O-ring 46 may include resilient material (e.g., elastomeric material) to provide a seal (e.g., a water-resistant seal) between connector body 112, nut 118, and post 116.

Figure 1E:
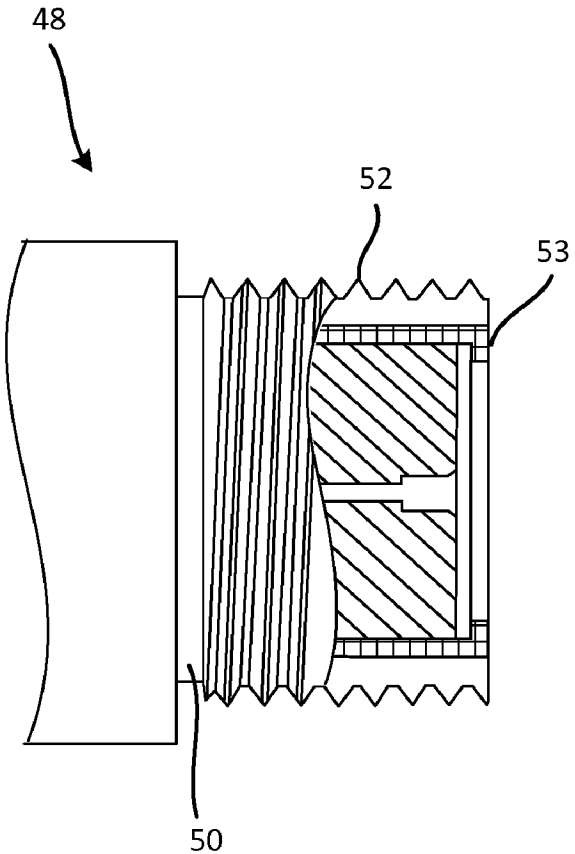
FIG. 1E is a cross-sectional drawing of a port connector to which the coaxial cable connector of FIG. 1A may be connected.

Once coaxial cable 56 is secured in connector 110, connector 110 may then be attached to a port connector of an external device. FIG. 1E shows a cross-sectional drawing of a port connector 48 to which connector 110 may be connected. As illustrated in FIG. 1E, port connector 48 may include a substantially cylindrical body 50 having external threads 52 that match internal threads 154 of rotatable nut 118. As discussed in further detail below, rotatable threaded engagement between threads 154 of nut 118 and threads 52 of port connector 48 may cause rearward surface 53 of port connector 48 to engage front surface 140 of flange 138 of post 116. The conductive nature of post 116 may provide an electrical path from surface 53 of port connector 48 to braid 64 around coaxial cable 56, providing proper grounding and shielding. As also discussed in more detail below, biasing element 115 may act to provide tension between external threads 52 and internal threads 154, reducing the likelihood that connector 110 will unintentionally back-off of port 48.

Figure 2B:
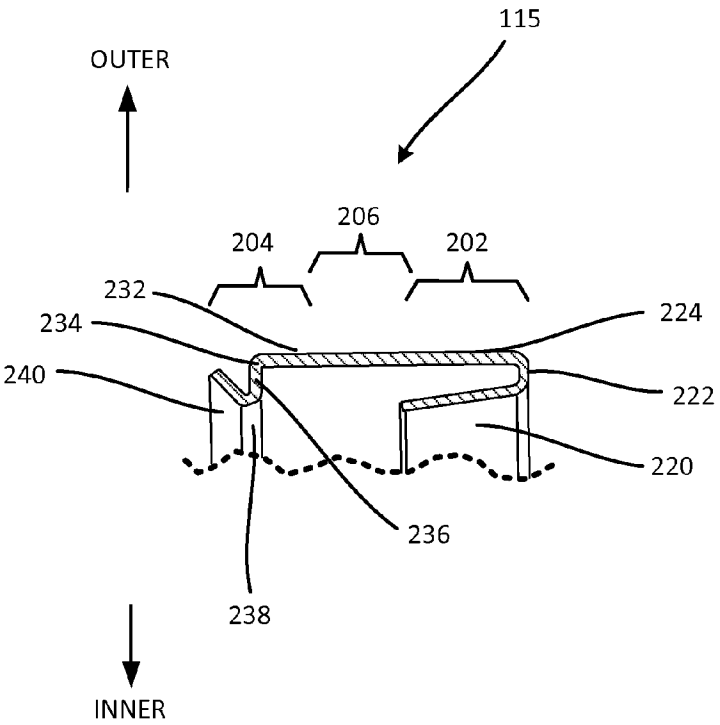
FIG. 2B is a cross-sectional drawing of the exemplary biasing element of FIG. 2A.
Figure 2A:
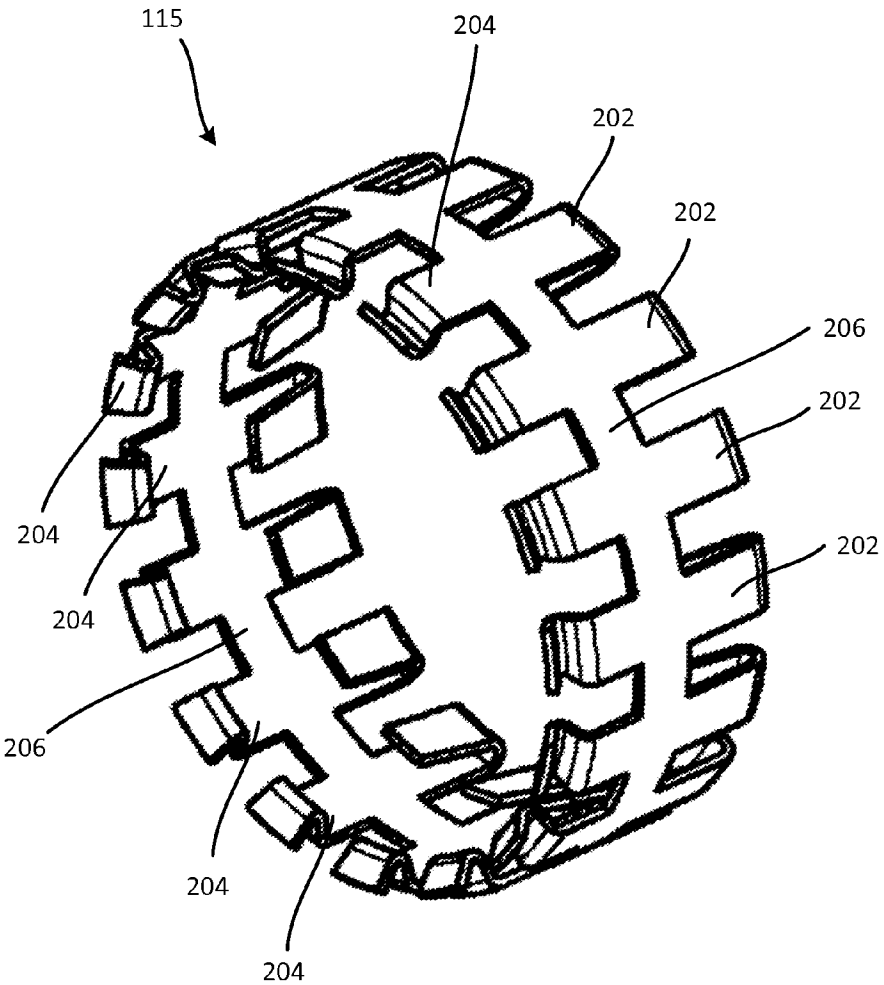
FIG. 2A is a perspective drawing of the exemplary biasing element of FIG. 1A.
Figures 3, 4:
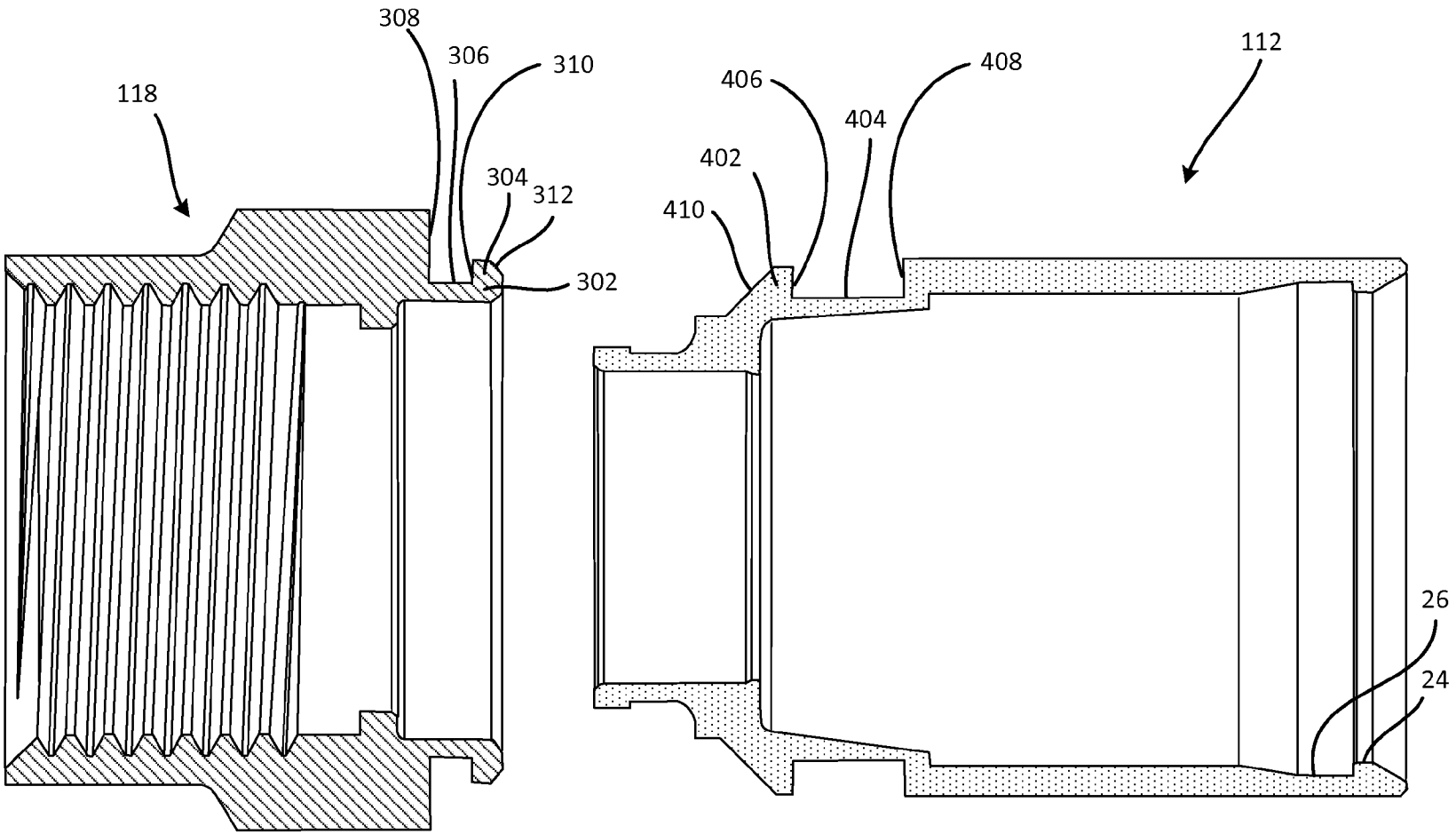
FIG. 3 is a cross-sectional drawing of the exemplary nut of the connector of FIG. 1A.
FIG. 4 is a cross-sectional drawing of the exemplary body of the connector of FIG. 1A.

Biasing element 115 is described in more detail with respect to FIGS. 2A and 2B, nut 118 is described in more detail with respect to FIG. 3, and body 112 is described in more detail with respect to FIG. 4. The cooperation between nut 118, biasing element 115, and body 112 is described in more detail with respect to FIGS. 5A through 8B.

FIG. 2A is a perspective drawing of exemplary biasing element 115. As shown, biasing element 115 may include a group of rearward fingers 202 (individually, "rearward finger 202"), a group of forward fingers 204 (individually, "forward finger 204"), and an annular portion 206. Annular portion 206 may connect and support rearward fingers 202 and forward fingers 204. Biasing element 115 may be made from plastic, metal, or any suitable material or combination of materials. In one embodiment, biasing element 115, nut 118, and body 112 are made of a conductive material (e.g., metal) to enhance conductivity between port connector 48 and post 116.

FIG. 2B is a cross-sectional drawing of exemplary biasing element 115 of FIG. 2A, depicting rearward finger 202 and forward finger 204 in additional detail. As shown, rearward finger 202 may include an inner member 220, an outer member 224, and/or an elbow 222 in between members 220 and 224. In one embodiment, elbow 222 may act as a spring and, in this embodiment, FIG. 2B shows inner member 220, outer member 224, and elbow 222 in a rest state. In this state, elbow 222 may provide a tension force to return rearward finger 202 to its rest state when inner member 220 and/or outer member 224 are moved relative to each other.

As shown in FIG. 2B, forward finger 204 includes a first member 232 and a second member 236 with an angled portion 234 in between. Forward finger 204 may also include a third member 240 with an elbow 238 in between third member 240 and second member 236. Angled portion 234 may act as a spring and, in this embodiment, FIG. 2B shows first member 232, angled portion 234, and second member 236 in a rest state. In this rest state, angled portion 234 may provide a tension force to return forward finger 204 to its rest state when first member 232 and/or second member 236 are moved relative to each other. Further, elbow 238 may also act as a spring and, in this embodiment, FIG. 2B shows second member 236, elbow 238, and third member 240 in a rest state. In this rest state, elbow 238 may provide a tension force to return forward finger 204 to its rest state when second member 236 and/or third member 240 are moved relative to each other.

In addition, annular portion 206, outer member 224, and/or first portion 232 may also act as a spring. In this embodiment, FIG. 2B shows annular portion 206, outer member 224, and first portion 232 in a rest state. When annular portion 206, outer member 224, and first portion 232 are moved relative to each other, for example, the spring nature of these components may create a tension force to return them to a rest state.

FIG. 3 is a cross-sectional drawing of exemplary nut 118 of FIGS. 1A and 1D. Nut 118 may provide for mechanical attachment of connector 110 to an external device, e.g., port connector 48, via a threaded relationship. Nut 118 may include any type of attaching mechanisms, including a hex nut, a knurled nut, a wing nut, or any other known attaching means. As shown, nut 118 includes a rear annular member 302 having an outward flange 304. Nut 118 may be made from plastic, metal, or any suitable material or combination of materials Annular member 302 and outward flange 304 form an annular recess 306. Annular recess 306 includes a forward wall 308 and a rear wall 310. Outward flange 304 may include a rear-facing beveled edge 312.

FIG. 4 is a cross-sectional drawing of connector body 112. Connector body 112 may include an elongated, cylindrical member, which can be made from plastic, metal, or any suitable material or combination of materials. Connector body 112 may include a cable receiving end that includes an inner sleeve-engagement surface 24 and a groove or recess 26. Opposite the cable-receiving end, connector body 112 may include an annular member (or flange) 402. Annular member 402 may form an annular recess 404 with the rest of connector body 112. As shown, recess 404 includes a forward wall 406 and a rear wall 408. In one embodiment, recess 404 includes forward wall 406, but no rear wall. That is, recess 404 is defined by annular member 402. Annular member 402 may also include a forward-facing bevel 410 leading up to recess 404. The cooperation of nut 118, body 112, and biasing element 115 is described with respect to FIGS. 5A through 8B below.

Figure 5A:
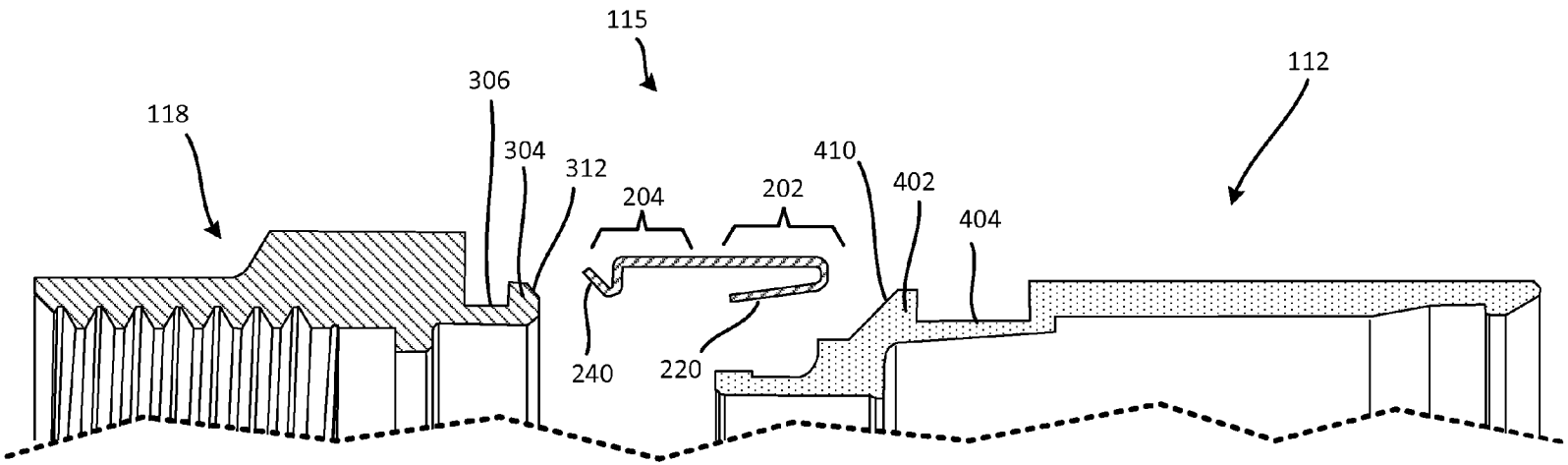
FIG. 5A is a cross-sectional drawing of the nut, body, and biasing element prior to assembly of the connector of FIG. 1A.
Figure 5B:
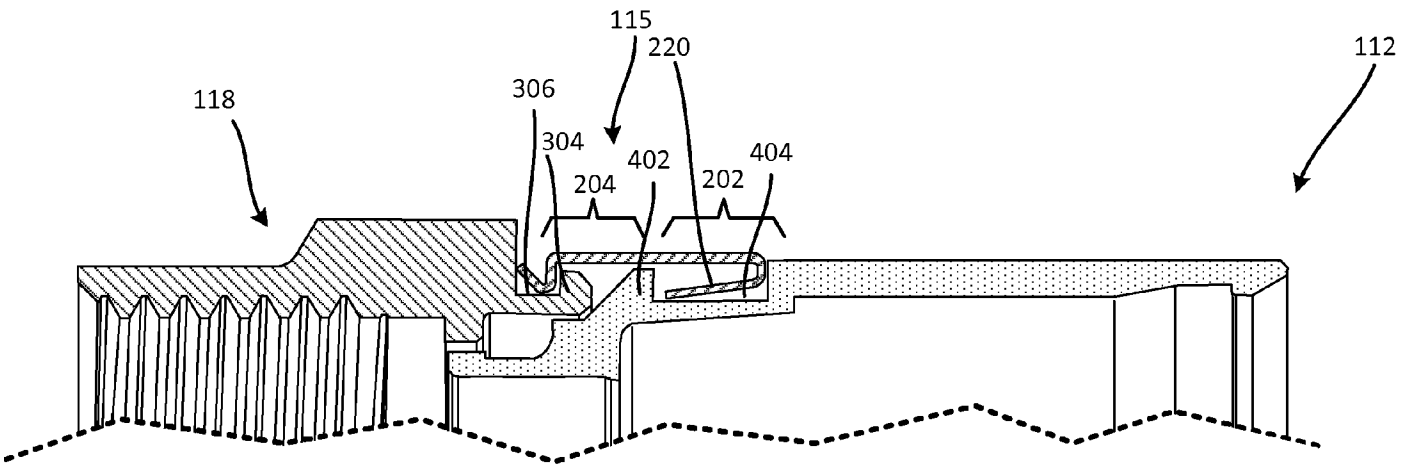
FIG. 5B is a cross-sectional drawing of the nut, body, and biasing element subsequent to assembly of the connector of FIG. 1A.

FIG. 5A is a cross-sectional drawing of nut 118, body 112, and biasing element 115 prior to assembly. FIG. 5B is a cross-sectional drawing of nut 118, body 112, and biasing element 115 after assembly. For simplicity, other components of connector 110 are omitted from FIGS. 5A and 5B. As shown, the angle of bevel 312 of nut 118 and the angle of third member 240 of biasing element 115 may complement each other such that when biasing element 115 and nut 118 are moved toward each other, forward finger 204 may snap over annular flange 304 and come to rest in recess 306 of nut 118 (as shown in FIG. 5B). Likewise, the angle of bevel 410 of body 112 and the angle of inner member 220 may complement each other such that when biasing element 115 and body 112 move toward each other, rearward finger 202 may snap over annular portion 402 and come to rest in annular recess 404 of body 112 (as shown in FIG. 5B). The spring nature of biasing element 115, as described above, may facilitate the movement of forward finger 204 over annular flange 304 of nut 118 and the movement of rearward finger 202 over annular portion 402 of body 112.

Figure 6A:
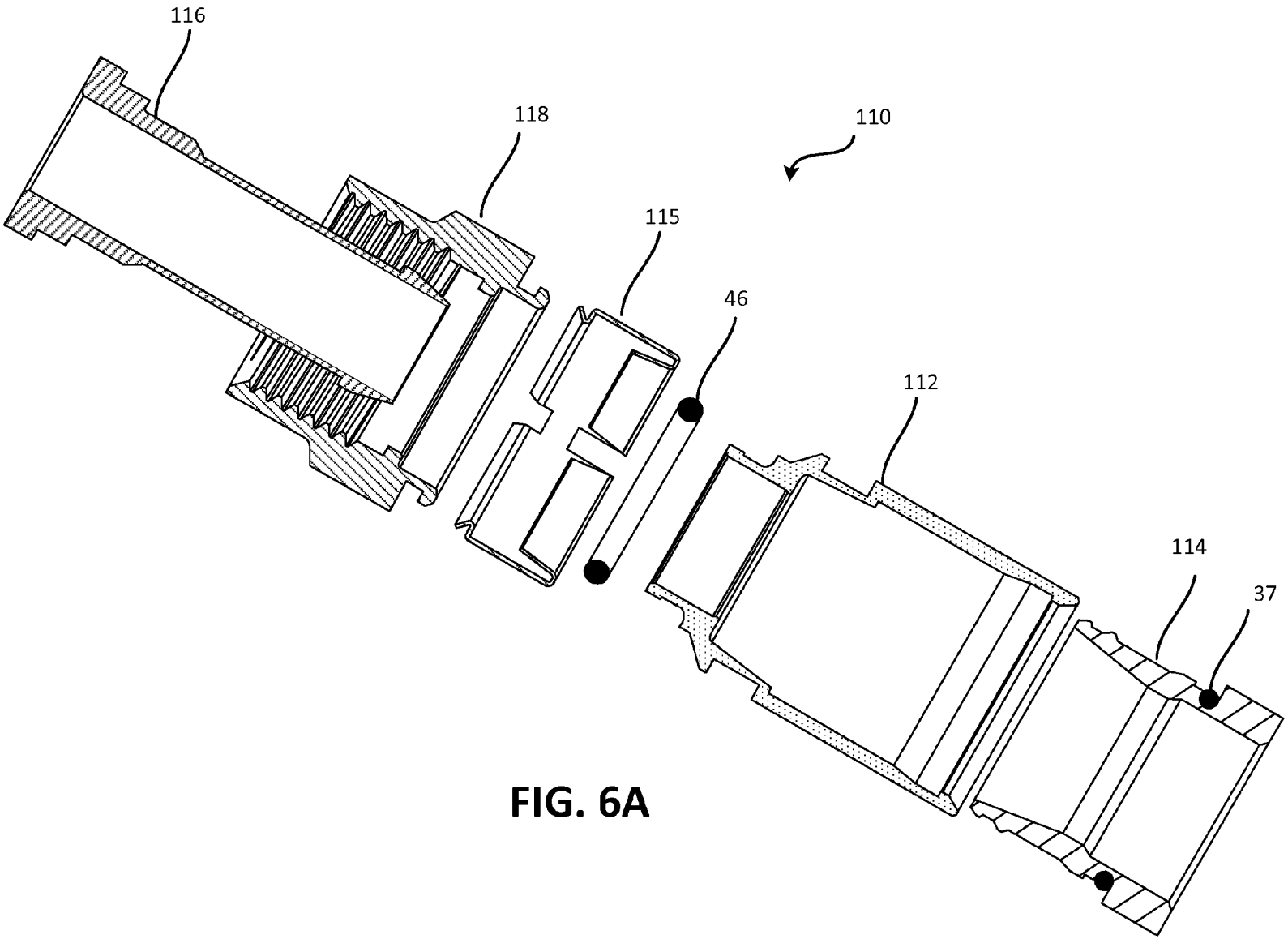
FIG. 6A is an exploded cross-sectional drawing of the unassembled components of the connector of FIG. 1A.

FIG. 6A is an exploded cross-sectional drawing of unassembled components of connector 110. As shown in FIG. 6A, connector 110 may include nut 118, body 112, locking sleeve 114, biasing element 115, post 116, an O-ring 46, and seal 37. In addition to body 112, biasing element 115, and nut 118 being assembled as shown in FIG. 5B, post 116 may be press fit into body 112, and locking sleeve 114 may be snapped onto the end of body 112, resulting in an assembled configuration shown in FIG. 6B and discussed above with respect to FIGS. 1A through 1E.

Figure 6B:
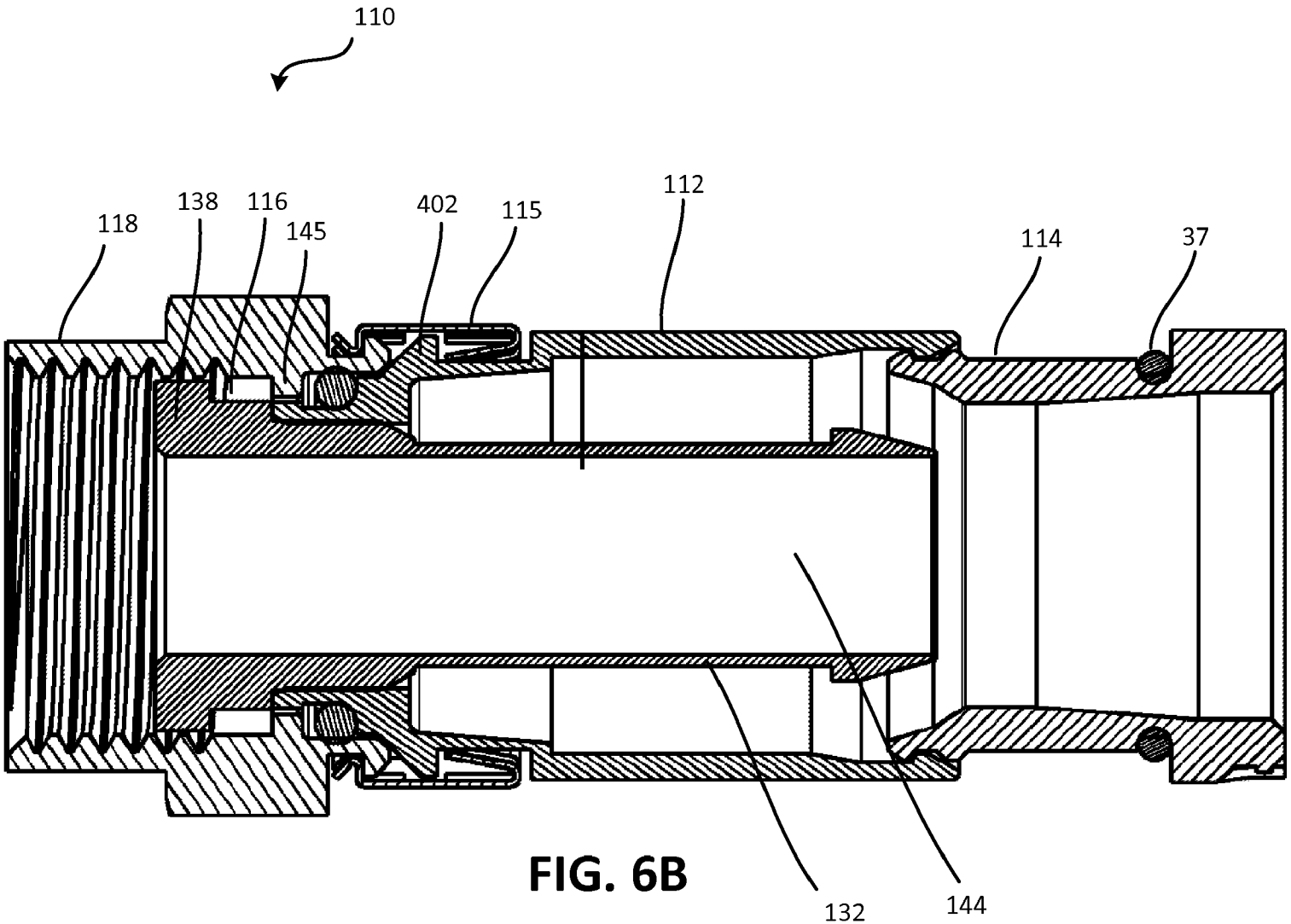
FIG. 6B is a cross-sectional drawing of the components of the connector of FIG. 1A in an assembled configuration.

FIG. 6B is a cross-sectional view of connector 110 in an assembled configuration. As illustrated in FIG. 6B, the external surface of post 116 may be secured into body 112 with an interference fit. Further, post 116 may secure nut 118 by capturing flange 145 of nut 118 between radially extending flange 402 of body 112 and flanged base portion 138 of post 116. In the configuration shown in FIG. 6B, nut 118 may be rotatably secured to post 116 and connector body 112. Tubular extension 132 of post 116 may extend rearwardly within body 112 and terminate adjacent the rearward end of connector body 112.

Figure 7A:
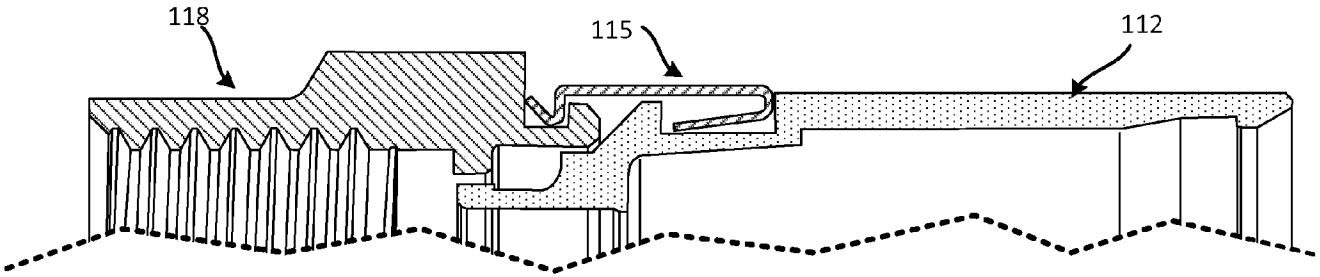
FIG. 7A is a cross-sectional drawing of the nut, body, and biasing element subsequent to assembly of the connector of FIG. 1A, wherein the biasing element is in a rest state.
Figure 7C:
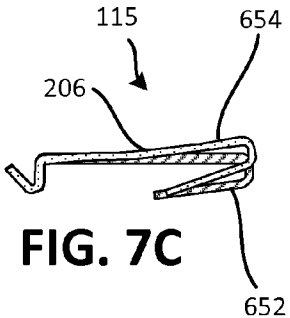
FIG. 7C is a cross-sectional drawing of the biasing element of the connector of FIG. 1A in a biased state and a rest state.
Figure 7B:
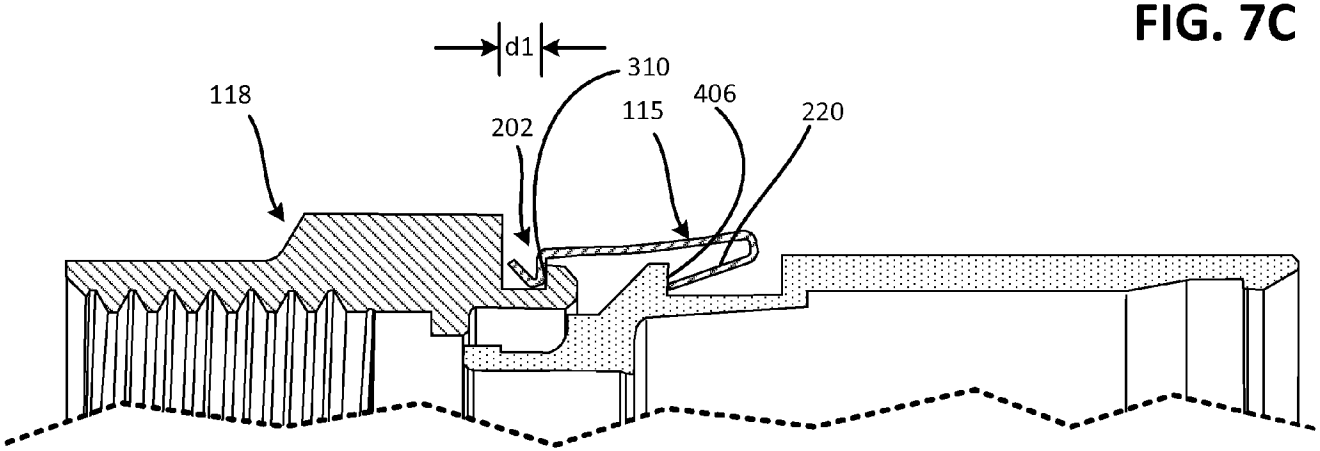
FIG. 7B is a cross-sectional drawing of the nut, body, and biasing element subsequent to assembly of the connector of FIG. 1A, wherein the biasing element is in a biased state.

FIG. 7A is a cross-sectional view of nut 118, body 112, and biasing element 115 in an assembled position, similar to the position shown in FIG. 5A. Again, other elements of connector 110 are omitted for ease of illustration. For example, after assembly, nut 118 may move a distance d1 in the forward direction relative to body 112, as shown in FIG. 7B relative to FIG. 7A. In this case, rear wall 310 of nut 118 may contact second member 236 of biasing element 115. Likewise, inner member 220 may contact front wall 406 of body 112. The displacement of nut 118 may flex biasing element 115 from its rest position (shown in FIG. 7A) to a biased position (shown in FIG. 7B). Biasing element 115 provides a tension force on nut 118 in the rearward direction and a tension force on body 112 in the forward direction. For ease of understanding, FIG. 7C is a cross-sectional drawing of biasing element 115 in a rest state 652 and a biased state 654. In the embodiment of FIG. 7C, in biased state 654, rearward finger 202 extends outward beyond annular portion 206. That is, in this embodiment, the outer diameter biasing element 115 increases from unbiased state 652 to biased state 654. In other embodiments, one of which is discussed below, the outer diameter of the biasing element does not increase as it moves from an unbiased state to a biased state.

Figure 8A:
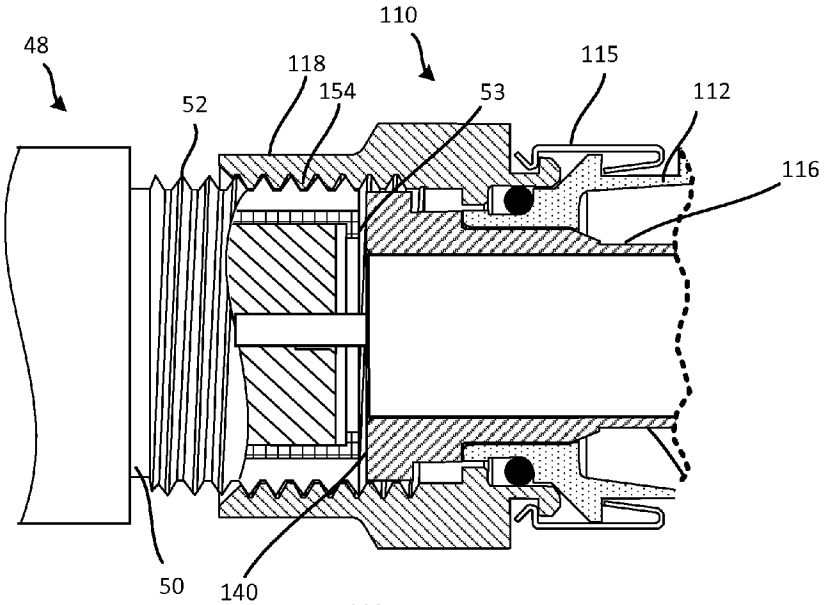
FIG. 8A is a cross-sectional drawing of the connector of FIG. 1A connected to a port, wherein the biasing element is in a rest state.

FIG. 8A is a cross-sectional drawing of the front portion of assembled connector 110 coupled to port connector 48. As shown, nut 118 has been rotated such that inner threads 154 of nut 118 engage outer threads 52 of port connector 48 to bring surface 53 of port connector 48 into contact with or near front surface 140 of flange 138 of post 116. In the position shown in FIG. 8A, biasing element 115 is in a rest state and not providing any tension force, for example. Thus, the positions of nut 118, body 112, and biasing element 115 relative to each other as shown in FIG. 8A is similar to that described above with respect to FIGS. 5B and 7A.

Figure 8B:
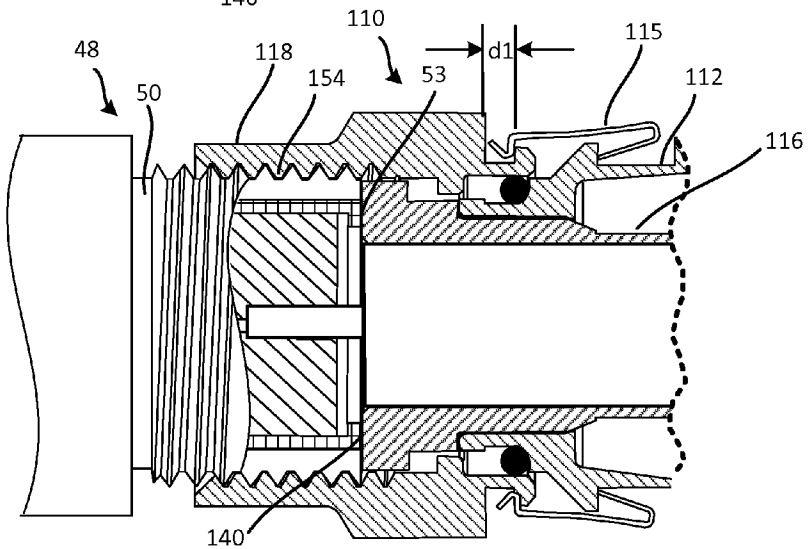
FIG. 8B is a cross-sectional drawing of the connector of FIG. 1A connected to a port, wherein the biasing element is in a biased state.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 112 and post 116. As such, biasing element 115 may move to a biased state as it captures kinetic energy of the rotation of nut 118 and stores the energy as potential energy. In this biased state, the positions of nut 118, body 112, and biasing element 115 relative to each other as shown in FIG. 8B is similar to that described above with respect to FIG. 7B. Biasing element 115 provides a load force on nut 118 in the rearward direction and a load force on body 112 in the forward direction. These forces are transferred to threads 52 and 154 (e.g., by virtue of rear surface 53 being in contact with post 116, which in this embodiment is fixed relative to body 112). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 115 may maintain pressure between surface 53 of port 48 and front surface 140 of post 116, which may help maintain electrical continuity and shielding.

Figure 9C:
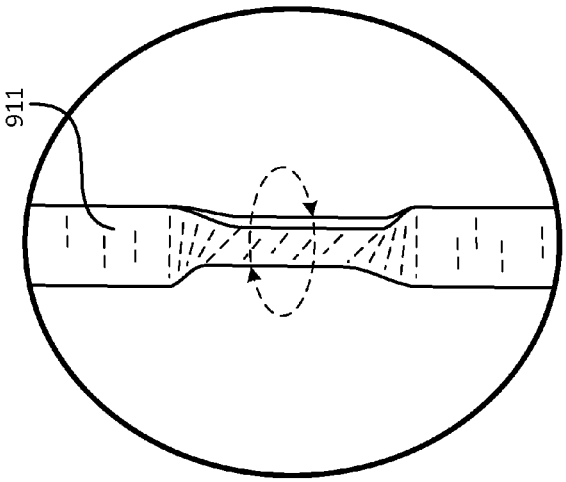
FIG. 9C is a drawing of the exemplary bridge portion of the biasing element of FIG. 9A.
Figure 9B:
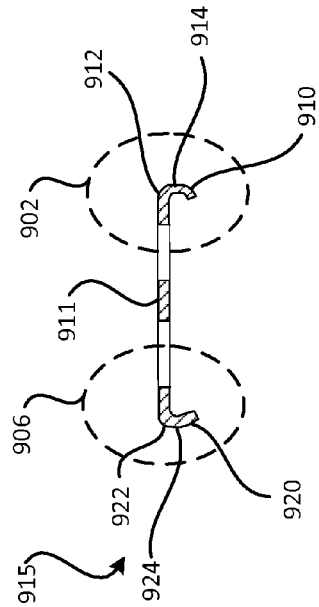
FIG. 9B is a cross-sectional drawing of the exemplary biasing element of FIG. 9A.
Figure 9A:
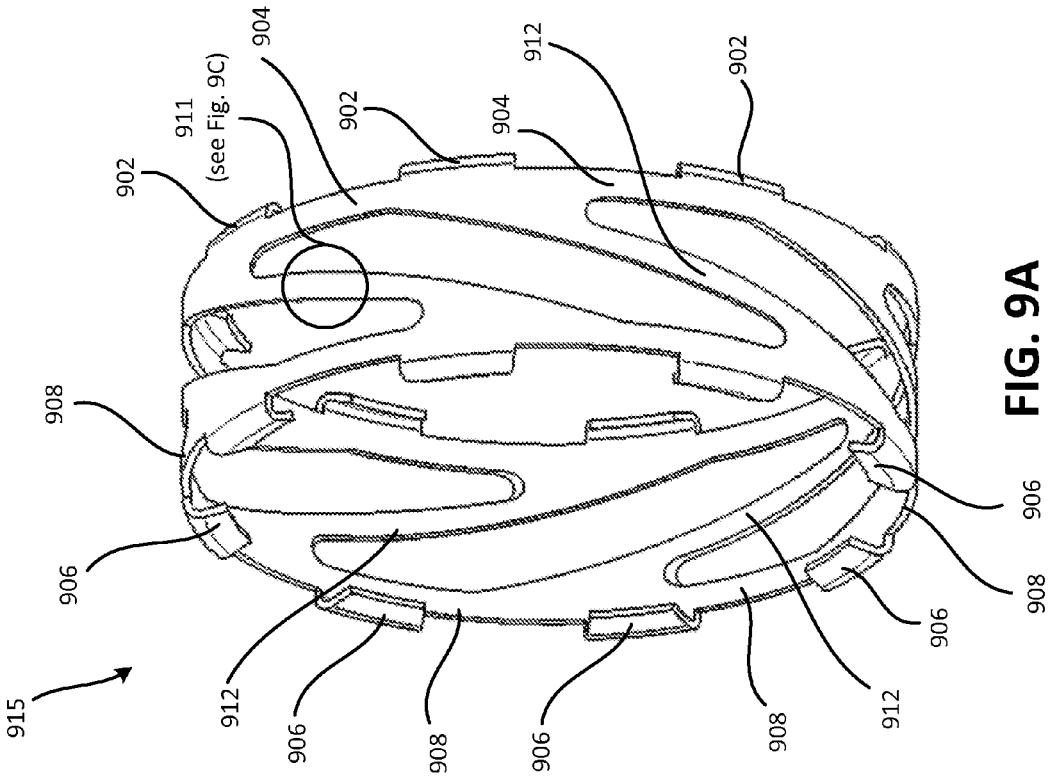
FIG. 9A is a perspective drawing of an exemplary biasing element in another embodiment.

FIG. 9A is a perspective drawing of a biasing element 915 in an alternative embodiment. Connector 110 of FIG. 1A, for example, may include biasing element 915 rather than biasing element 115 as shown. Biasing element 915 may include rearward fingers 902 (individually, "rearward finger 902"), a rearward annular support 904, forward fingers 906 (individually, "forward finger 906"), and a rearward annular support 908. A bridge portion 911 may span between rearward annular support 904 and forward annular support 908. Biasing element 915 may be made from plastic, metal, or any suitable material or combination of materials. In one embodiment, biasing element 915, nut 118, and body 112 are made of a conductive material (e.g., metal) to enhance conductivity between port connector 48 and post 116.

FIG. 9B is a cross-sectional drawing of biasing element 915. As shown, rearward finger 902 includes an inner portion 910, an outer portion 912, and an elbow portion 914 between the two. In one embodiment, elbow portion 914 may act as a spring and, in this embodiment, FIG. 9B shows inner portion 910, outer portion 912, and elbow portion 914 in a rest state. Elbow portion 914 may provide a tension force to return rearward finger 902 to its rest state when inner portion 910, outer portion 912, and/or elbow portion 914 are moved relative to each other.

As shown, forward finger 906 includes an inner portion 920, an outer portion 922, and an elbow portion 924 in between the two. In one embodiment, elbow portion 924 may act as a spring and, in this embodiment, FIG. 9B shows inner portion 920, outer portion 922, and elbow portion 924 in a rest state. In this embodiment, elbow portion 924 may provide a tension force to return forward finger 906 to its rest state when inner portion 920, outer portion 922, and/or elbow portion 924 are moved relative to each other.

Bridge portion 911 spans between forward annular support 904 and rearward annular support 908. In one embodiment, bridge portion 911 may act as a spring and, in this embodiment, FIGS. 9A and 9B show biasing element 915 in a rest state. Bridge portion 911 may act to return biasing element 915 to its rest state when, for example, rearward annular support 904 and forward annular support 908 move away from each other or move toward each other. FIG. 9C is a drawing of bridge portion 911 in one embodiment. In this embodiment, bridge portion 911 is twisted, e.g., by ninety degrees. This embodiment may allow for more spring in bridge portion 911, for example.

Figure 10A:
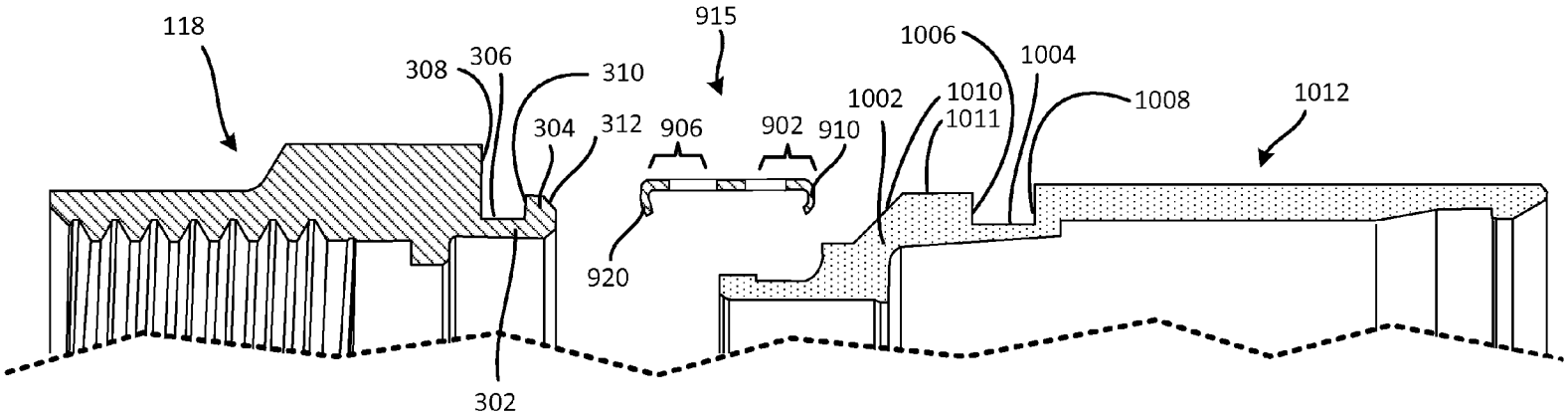
FIG. 10A is a cross-sectional drawing of an exemplary nut and connector body including the biasing element of FIG. 9A prior to assembly.

FIG. 10A is a cross-sectional drawing of nut 118 and a connector body 1012 in an other embodiment, including biasing element 915. Nut 118, as shown in FIG. 10, includes annular recess 306 having a front wall 308 and a rear wall 310. Nut 118 includes an annular member 302 having an outwardly protruding flange 304 with a beveled edge 312. Connector body 1012, like body 112, may include an elongated, cylindrical member, which can be made from plastic, metal, or any suitable material or combination of materials. Opposite a cable-receiving end, connector body 1012 may include an annular member (or flange) 1002. Annular member 1002 may form an annular recess 1004 between annular member 1002 and the rest of connector body 1012. As shown, recess 1004 includes a forward wall 1006 and a rear wall 1008. In one embodiment, recess 1004 includes forward wall 1006, but no rear wall. That is, recess 1004 is defined by annular member 1002. Annular member 1002 may also include a forward-facing bevel 1010 leading up to recess 1004.

Figure 10B:
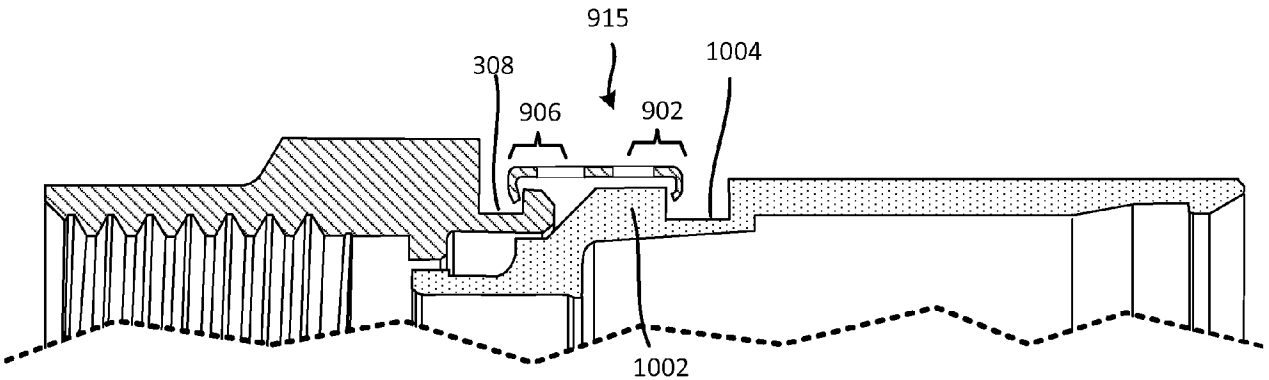
FIG. 10B is a cross-sectional drawing of the exemplary nut and connector body of FIG. 10A including the biasing element of FIG. 9A in an assembled configuration.

As shown in FIG. 10A, the angle of bevel 312 of nut 118 and the angle of inner portion 920 of biasing element 915 may complement each other such that when biasing element 915 and nut 118 are moved toward each other, forward finger 906 may snap over annular flange 304 and come to rest in recess 306 of nut 118 (as shown in FIG. 10B). Likewise, the angle of bevel 1010 of body 1012 and the angle of inner portion 910 may complement each other such that when biasing element 915 and body 1012 move toward each other, rearward finger 902 may snap over annular portion 1002 and come to rest in annular recess 1004 of body 1012 (as shown in FIG. 10B). The spring nature of biasing element 915, as described above, may facilitate the movement of forward finger 906 over annular flange 304 of nut 118 and the movement of rearward finger 902 over annular portion 1002 of body 1012.

Figure 11A:
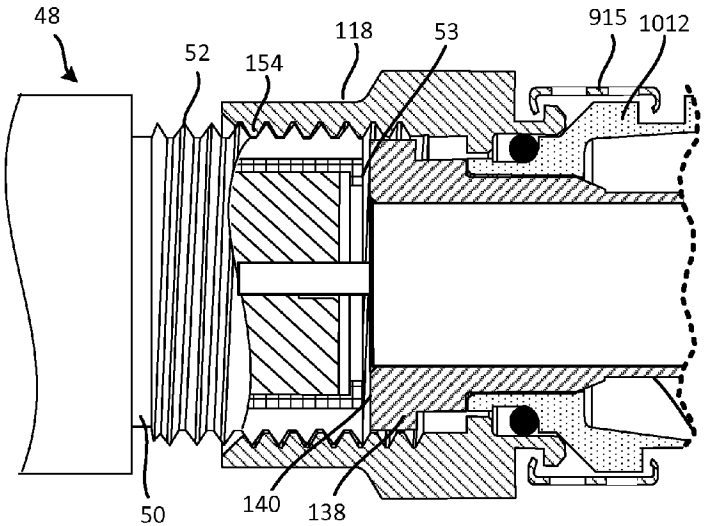
FIG. 11A is a cross-sectional drawing of the connector of FIG. 10A, including the biasing element of FIG. 9A, attached to a port, wherein the biasing element is in a rest state.
Figure 11B:
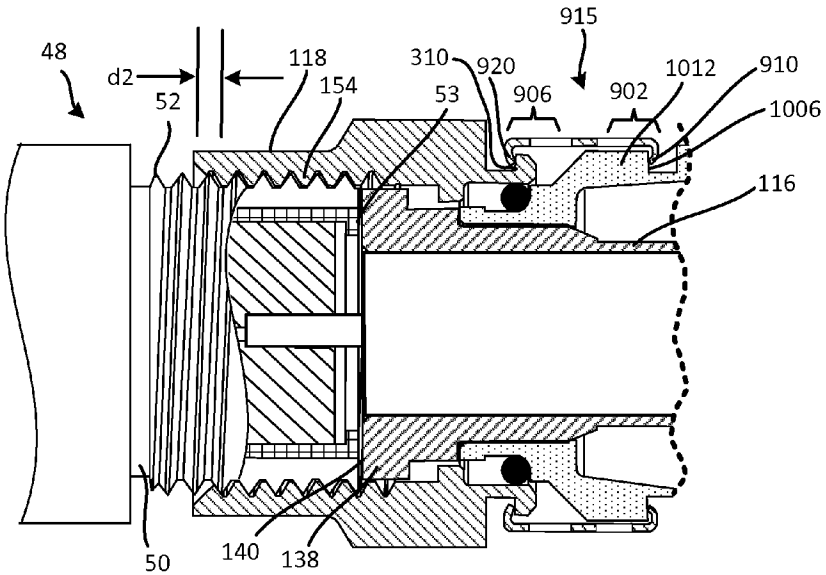
FIG. 11B is a cross-sectional drawing of the connector of FIG. 10A, including the biasing element of FIG. 9A, attached to a port, wherein the biasing element is in a biased state.

FIGS. 11A and 11B are cross-sectional drawings of port 48 coupled to a connector that incorporates biasing element 915, post 116, body 1012, and nut 118. FIG. 11A shows biasing element 915 in an unbiased state, while FIG. 11B shows biasing element 915 in a biased state. As shown, nut 118 has been rotated such that inner threads 154 of nut 118 engage outer threads 52 of port connector 48 to bring surface 53 of port connector 48 into contact with or near front surface 140 of flange 138 of post 116. In the position shown in FIG. 11A, biasing element 915 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 1012 and post 116. As shown in FIG. 11B as compared to FIG. 11A, nut 118 may move a distance d2 in the forward direction relative to body 1012. In this case, rear wall 310 of nut 118 may contact inner portion 920 of forward finger 906 of biasing element 915. Likewise, inner portion 910 of rear finger 902 may contact front wall 1006 of body 1012. The displacement of nut 118 may flex biasing element 915 from its rest position (shown in FIG. 11A) to a biased position (shown in FIG. 11B). Biasing element 915 provides a tension force on nut 118 in the rearward direction and a tension force on body 1012 in the forward direction.

As biasing element 915 moves to a biased state, it captures kinetic energy of the rotation of nut 118 and stores the energy as potential energy. Biasing element 915 provides a load force on nut 118 in the rearward direction and a load force on body 1012 in the forward direction. These forces are transferred to threads 52 and 154 (e.g., by virtue of rear surface 53 being in contact with post 116, which in this embodiment is fixed relative to body 1012). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 915 may maintain pressure between surface 53 of port 48 and front surface 140 of post 116, which may help maintain electrical continuity and shielding.

Figure 12B:
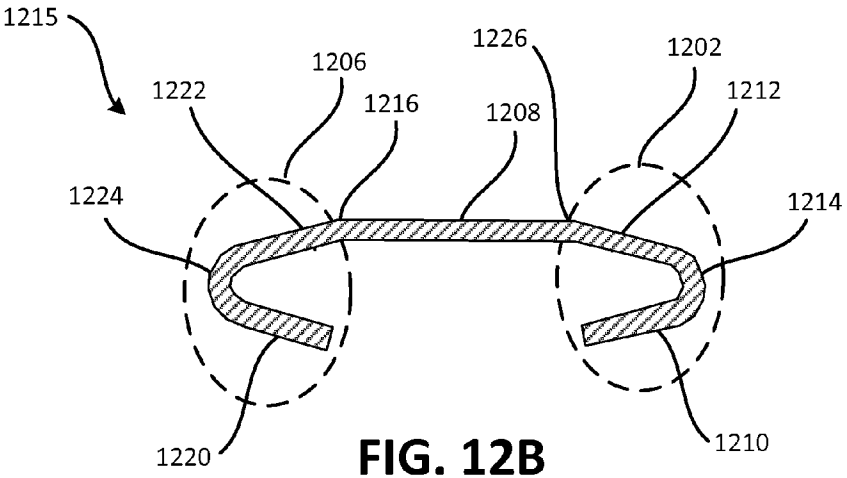
FIG. 12B is a cross-sectional drawing of the exemplary biasing element of FIG. 12A.
Figure 12C:
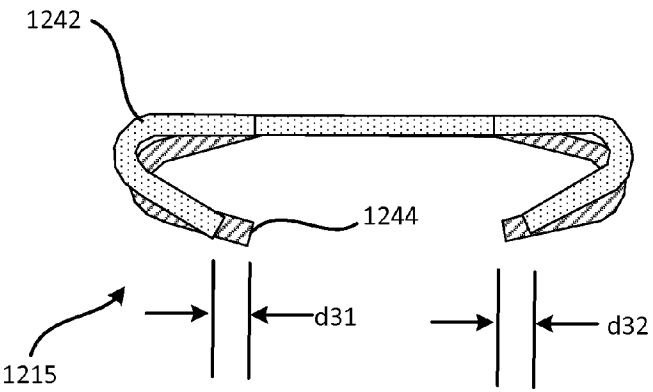
FIG. 12C is a cross-sectional drawing of the biasing element of FIG. 12A in a biased state and a rest state.
Figure 12A:
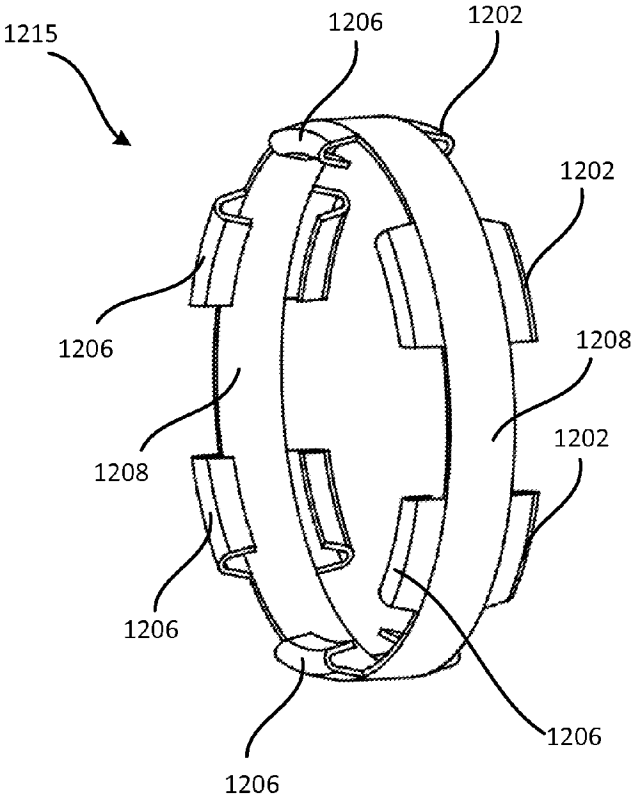
FIG. 12A is a perspective drawing of a biasing element in another embodiment.
Figure 14:
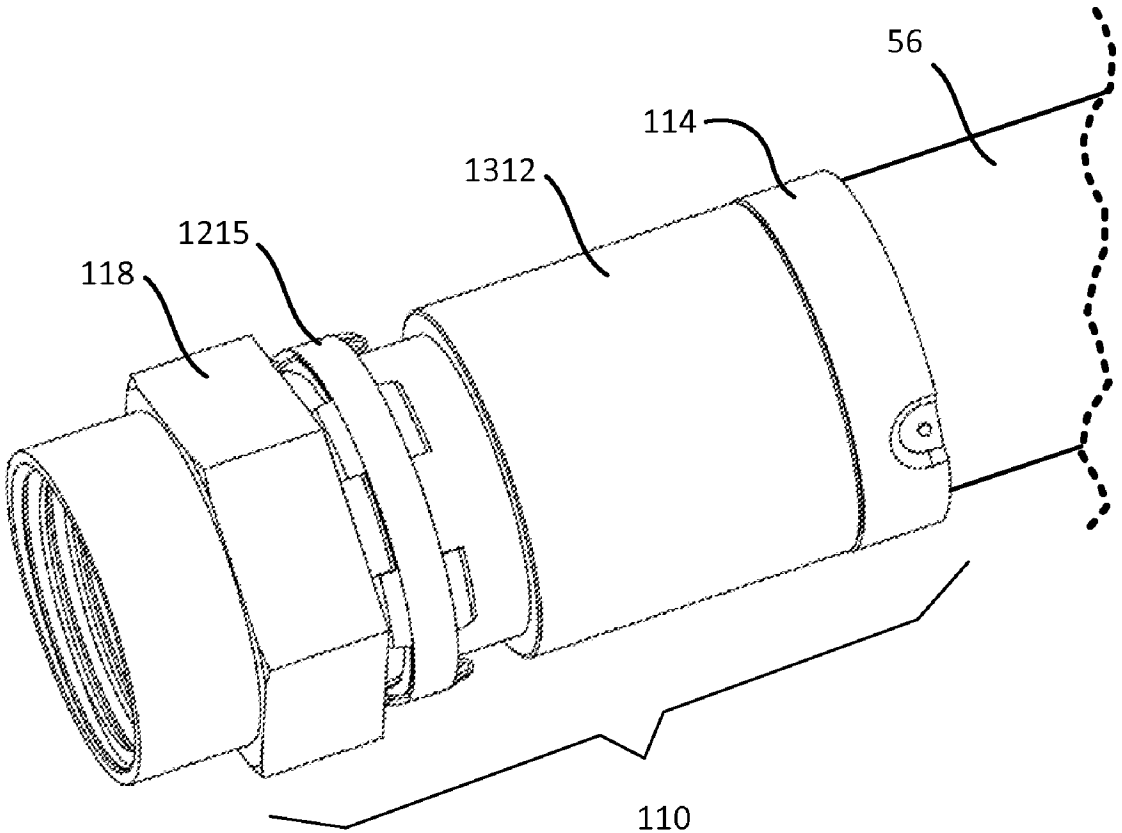
FIG. 14 is a perspective drawing of an exemplary coaxial cable connector in an assembled configuration with the exemplary biasing element of FIG. 12A.

FIG. 12A is a perspective drawing of a biasing element 1215 in an alternative embodiment. Connector 110 of FIG. 1A, for example, may include biasing element 1215 rather than biasing element 115 as shown. FIG. 14 is a drawing of a perspective view of a connector with biasing element 2115. Biasing element 1215 may include rearward fingers 1202 (individually, "rearward finger 1202"), forward fingers 1206 (individually, "forward finger 1206"), and an annular support 1208. Annular support 1208 may provide support for forward fingers 1206 and rearward fingers 1202. Biasing element 1215 may be made from plastic, metal, or any suitable material or combination of materials. In one embodiment, biasing element 1215, nut 118, and the body are made of conductive material (e.g., metal) to enhance conductivity between port connector 48 and post 116.

FIG. 12B is a cross-sectional drawing of biasing element 1215. As shown, rearward finger 1202 includes an inner portion 1210, an outer portion 1212, and an elbow portion 1214 between the two. In one embodiment, elbow portion 1214 may act as a spring and, in this embodiment, FIG. 12B shows inner portion 1210, outer portion 1212, and elbow portion 1214 in a rest state. In this state, elbow portion 1214 may provide a tension force to return rearward finger 1202 to its rest state when inner portion 1210 and/or outer portion 1212 are moved relative to each other.

As shown, forward finger 1206 includes an inner portion 1220, an outer portion 1222, and an elbow portion 1224 between the two. In one embodiment, elbow portion 1224 may act as a spring and, in this embodiment, FIG. 12B shows inner portion 1220, outer portion 1222, and elbow portion 1224 in a rest state. In this embodiment, elbow portion 1224 may provide a tension force to return forward finger 1206 to its rest state when inner portion 1220 and/or outer portion 1222 are moved relative to each other.

Further, biasing element 1215 may include a bend 1216 between forward finger 1206 and annular support 1208. Biasing element 1215 may also include a bend 1226 between rearward finger 1202 and annular support 1208. Bends 1216 and 1226 may also act as a spring. In this embodiment, as shown in FIG. 12B, rearward finger 1202, forward finger 1206, and annular support 1208 are in a rest state relative to each other. FIG. 12C shows biasing element 1215 in a rest state 1244 and a biased state 1242. In biased state 1242, a tension force may act to return biasing element 1215 to its rest state 1244. The distance between the ends of inner portion 1220 and inner portion 1210 increases by a distance d3 as biasing element 1215 moves from rest state 1244 to biased state 1242, wherein d3 is the sum of the distances d31 and d32 shown in FIG. 12C. In the embodiment of FIG. 12C, in biased state 1242, forward finger 12016 and rearward finger 1202 do not extend outward beyond annular support 1208. That is, in this embodiment, the outer diameter biasing element 1215 does not increase from unbiased stage 1244 to biased state 1242.

Figure 13A:
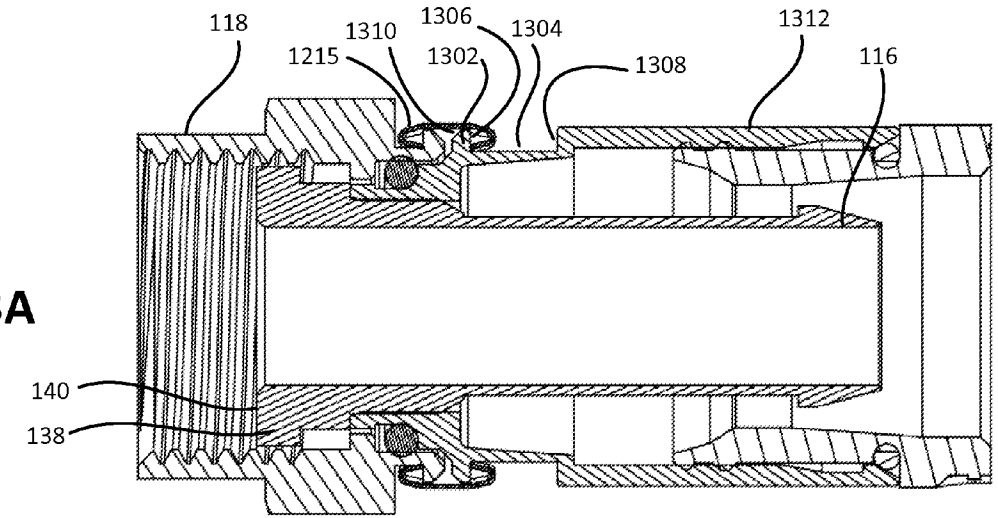
FIG. 13A is a cross-sectional drawing of a connector, including the biasing element of FIG. 12A, wherein the biasing element is in a rest state.

FIG. 13A is a cross-sectional drawing of nut 118, a body 1312, and post 116 in another embodiment. Nut 118, as shown in FIG. 3, includes annular recess 306 having a front wall 308 and a rear wall 310. Nut 118 includes an annular member 302 having an outwardly protruding flange 304 with a beveled edge 312. Connector body 1312, like body 112, may include an elongated, cylindrical member, which can be made from plastic, metal, or any suitable material or combination of materials. Opposite a cable-receiving end, connector body 1312 may include an annular member (or flange) 1302. Annular member 1302 may form an annular recess 1304 between annular member 1302 and the rest of connector body 1312. As shown, recess 1304 includes a forward wall 1306 and a rear wall 1308. In one embodiment, recess 1304 includes forward wall 1306, but no rear wall. That is, recess 1304 is defined by annular member 1302. Annular member 1302 may also include a forward-facing bevel 1310 leading up to recess 1304.

The angle of bevel 312 of nut 118 and the angle of inner portion 1220 of biasing element 1215 may complement each other such that when biasing element 1215 and nut 118 are moved toward each other, forward finger 1206 may snap over annular flange 304 and come to rest in recess 306 of nut 118 (as shown in FIG. 13A). Likewise, the angle of bevel 1310 of body 1312 and the angle of inner portion 1210 of biasing element 1215 may complement each other such that when biasing element 1215 and body 1312 move toward each other, rearward finger 1202 may snap over annular portion 1302 and come to rest in annular recess 1304 of body 1312 (as shown in FIG. 13A). The spring nature of biasing element 1215, as described above, may facilitate the movement of forward finger 1206 over annular flange 304 of nut 118 and the movement of rearward finger 1202 over annular portion 1302 of body 1312.

Figure 13B:
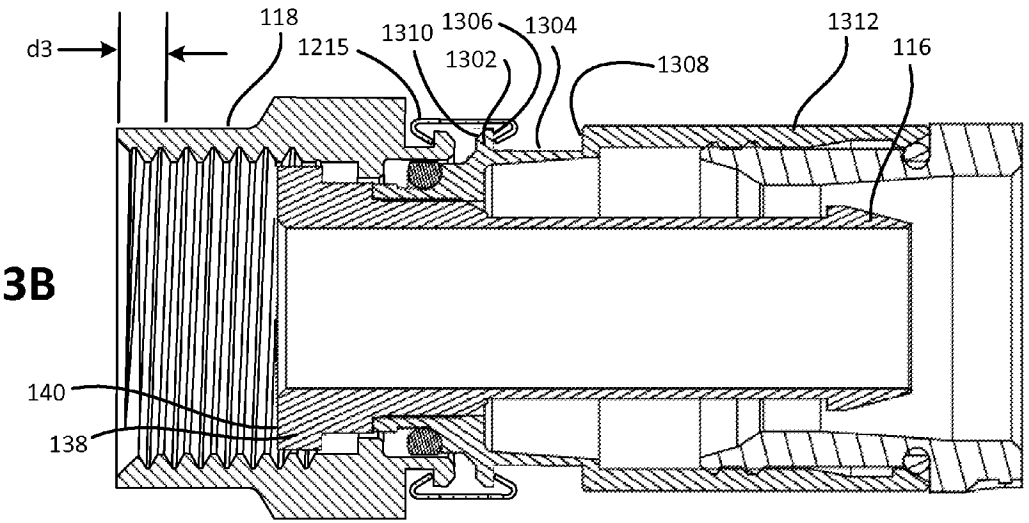
FIG. 13B is a cross-sectional drawing of a connector, including the biasing element of FIG. 12A, wherein the biasing element is in a biased state.

Similar to discussions above with respect to biasing element 115 and 915, the connector shown in FIGS. 13A and 13B may be attached to port 48 (see FIGS. 11A and 11B). In this case, nut 118 may be rotated such that inner threads 154 of nut 118 engage outer threads 52 of port connector 48 to bring surface 53 of port connector 48 into contact with or near front surface 140 of flange 138 of post 116. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 1312 and post 116. In this case, nut 118 may move a distance d3, for example, in the forward direction relative to body 1012. In this case, rear wall 310 of nut 118 may contact inner portion 1220 of forward finger 1206 of biasing element 1215. Likewise, inner portion 1210 of rear finger 1202 may contact front wall 1306 of body 1312. The displacement of nut 118 may flex biasing element 1215 from its rest position 1244 (shown in FIG. 12C) to biased position 1242 (shown in FIG. 12B). Biasing element 1215 provides a tension force on nut 118 in the rearward direction and a tension force on body 1312 in the forward direction.

As biasing element 1215 moves to a biased state, it captures kinetic energy of the rotation of nut 118 and stores the energy as potential energy. Biasing element 1215 provides a load force on nut 118 in the rearward direction and a load force on body 112 in the forward direction. These forces are transferred to threads 52 and 154 (e.g., by virtue of rear surface 53 of port 48 being in contact with post 116, which in this embodiment is fixed relative to body 1312). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 1215 may maintain pressure between surface 53 of port 48 and front surface 140 of post 116, which may help maintain electrical continuity and shielding.

Figure 15A:
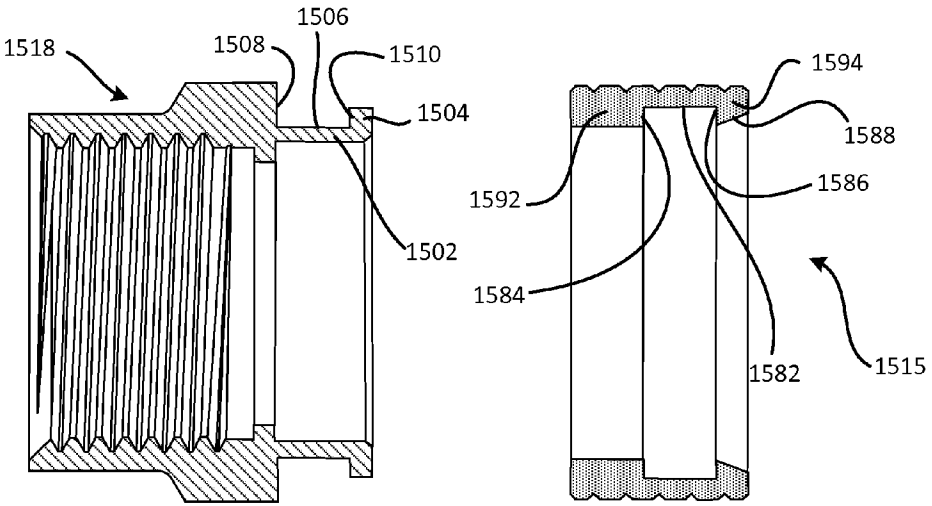
FIG. 15A is a cross-sectional drawing of an exemplary nut and biasing element in another embodiment.
Figure 17:
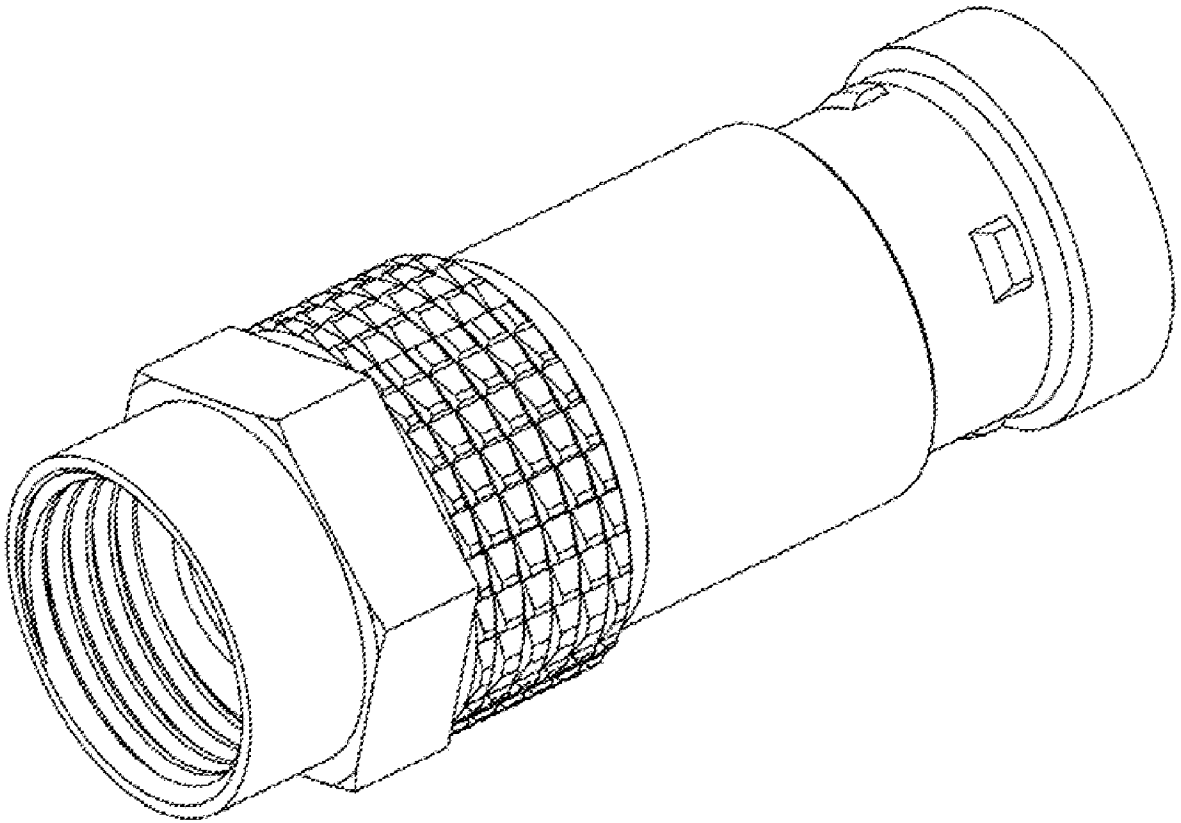
FIG. 17 is a perspective drawing of the biasing element, nut, and connector body of FIG. 15A in an assembled configuration.

In one embodiment, the biasing element may be constructed of a resilient, flexible material such as rubber or a polymer. FIG. 15A is a cross-sectional drawing of a biasing element 1515 and a nut 1518 in one embodiment. FIG. 17 is a perspective drawing of a connector incorporating biasing element 1515 in an assembled state, but not attached to a cable. As shown, biasing element 1515 includes a tubular member having inner and outer surfaces. The inner surface may include an inner recess 1582 having a front wall 1584 and a rear wall 1586. Inner recess 1582 divides biasing element 1515 into a forward end 1592 and a rearward end 1594. The inner surface may also include a rearward facing bevel 1588. The outer surface may include a pattern (e.g., an uneven surface or a knurl pattern) to improve adhesion of biasing element 1515 with an operator's hands. Biasing element 1515 may act as a spring. In this embodiment, FIG. 15A shows biasing element 1515 in its rest state. Any deformation of biasing element 1515 may result in a tension or load force in the direction to return biasing element 1515 to its rest state. Biasing element 1515 may be made from elastomeric material, plastic, metal, or any suitable material or combination of materials. In one embodiment, biasing element 1515, nut 1518, and the connector body are made of a conductive material to enhance conductivity between port connector 48 and post 116.

Nut 1518 may provide for mechanical attachment of a connector to an external device, e.g., port connector 48, via a threaded relationship. Nut 1518 may include any type of attaching mechanisms, including a hex nut, a knurled nut, a wing nut, or any other known attaching means. Nut 1518 may be made from plastic, metal, or any suitable material or combination of materials. As shown, nut 1518 includes a rear annular member 1502 having an outward flange 1504. Annular member 1502 and outward flange 1504 form an annular recess 1506. Annular recess 1506 includes a forward wall 1508 and a rear wall 1510. Unlike nut 118, nut 1518 may not include a rear-facing beveled edge (e.g., beveled edge 312).

Figure 15B:
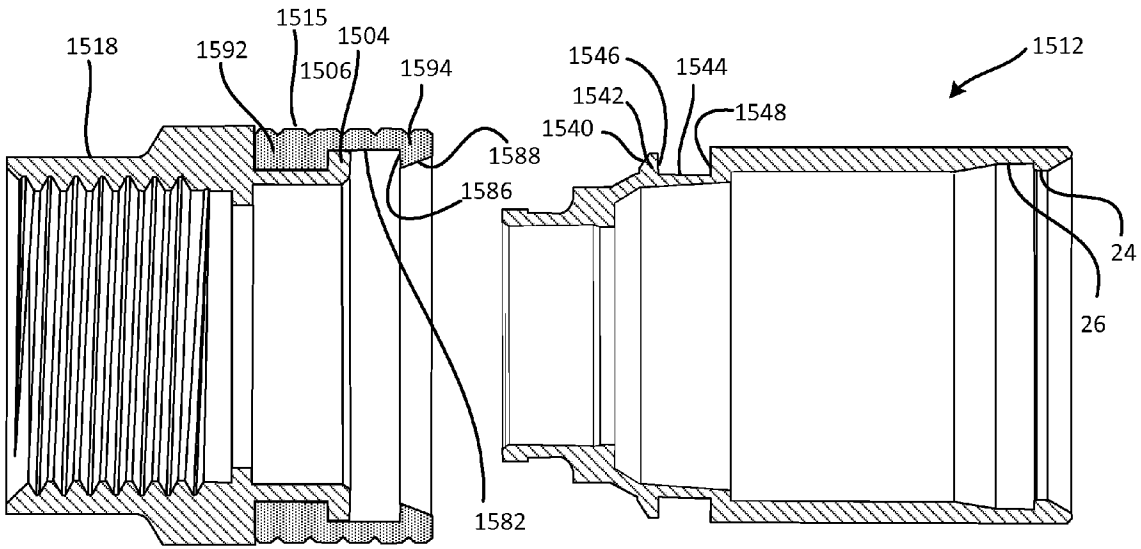
FIG. 15B is a cross-sectional drawing of the nut and biasing element of FIG. 15A and a connector body, wherein the nut and biasing element are coupled together but not coupled to the connector body.

Biasing element 1515 may be over-molded onto nut 1518. FIG. 15B is a cross-sectional drawing of a connector body 1512, nut 1518, and biasing element 1515. As shown in FIG. 15B relative to FIG. 15A, recess 1506 of nut 1518 may be used to form forward end 1592 of biasing element 1515. Further, annular flange 1504 of nut 1518 may be used to form a portion of annular recess 1582 of biasing element 1515, including front wall 1584 of recess 1582. The rest of the inner surface of biasing element 1515 (e.g., the remaining portion of recess 1582, rear wall 1586, and bevel 1588, etc.) may be formed using a collapsible mold structure (not shown), for example. In one embodiment, after over-molding biasing element 1515 onto nut 1518, and collapsing the mold structure that forms the remainder of the inner surface of biasing element 1515 not formed by nut 1518, the resulting arrangement of nut 1518 and biasing element 1515 may be as shown in FIG. 15B.

As shown in FIG. 15B, connector body 1512 may include an elongated, cylindrical member, which can be made from plastic, metal, or any suitable material or combination of materials. Connector body 1512 may include a cable receiving end that includes an inner sleeve-engagement surface 24 and a groove or recess 26. Opposite the cable-receiving end, connector body 1512 may include an annular member (or flange) 1542. Annular member 1542 may form an annular recess 1544 with the rest of connector body 1512. As shown, recess 1544 includes a forward wall 1546 and a rear wall 1548. In one embodiment, recess 1544 includes forward wall 1546, but no rear wall. That is, recess 1544 is defined by annular member 1542. Annular member 1542 may also include a forward-facing bevel 1540 leading up to recess 1544.

Figure 16A:
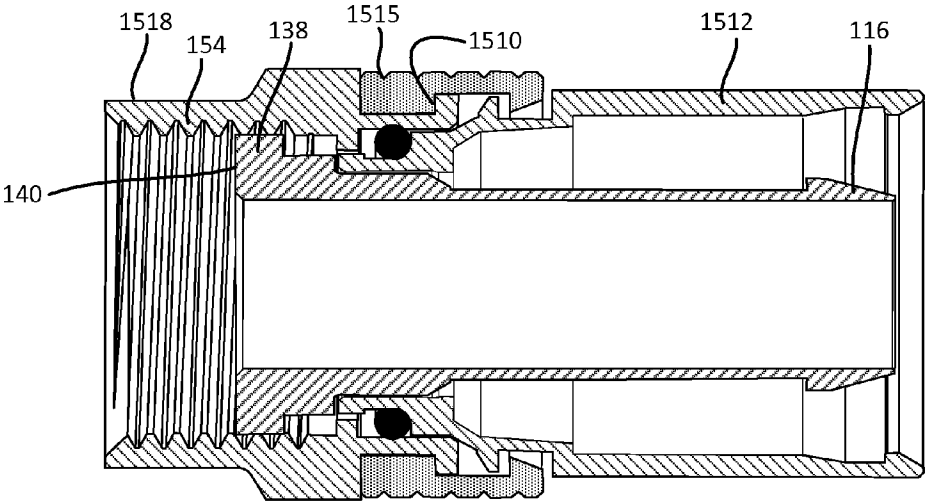
FIG. 16A is a cross-sectional drawing of the biasing element, nut, and connector body of FIG. 15B in an assembled configuration, wherein the biasing element is in a rest state.

As shown in FIG. 15B, the angle of bevel 1540 of body 1512 and the angle of bevel 1588 of biasing element 1515, may complement each other such that when biasing element 1515 and body 1512 move toward each other, rearward portion 1594 may snap over annular portion 1542 and come to rest in annular recess 1544 of body 1512 (as shown in FIG. 16A discussed below). The spring nature of biasing element 1515, as described above, may facilitate the movement of rearward portion 1594 over annular portion 1542 of body 1512.

Figure 16B:
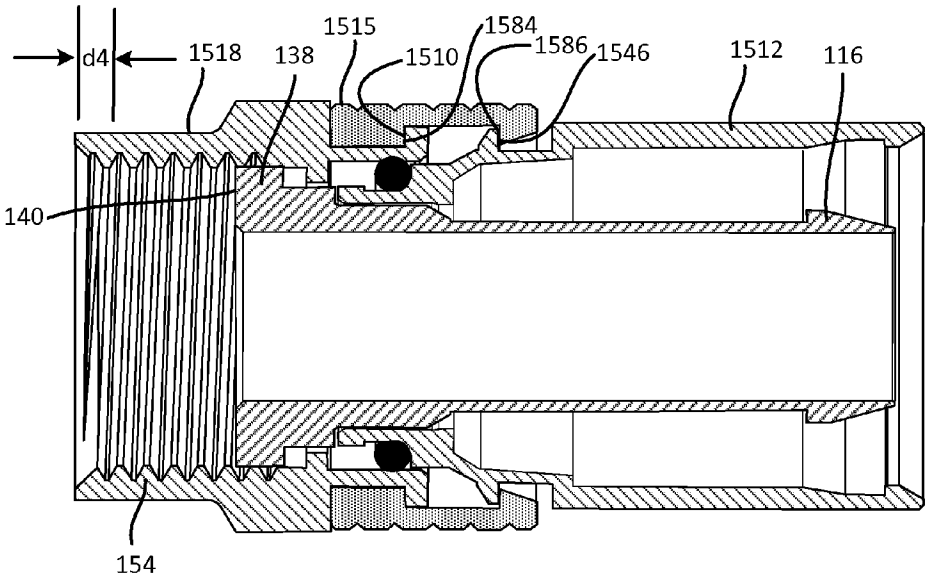
FIG. 16B is a cross-sectional drawing of the biasing element, nut, and connector body of FIG. 15B in an assembled configuration, wherein the biasing element is in a biased state.

FIGS. 16A and 16B are cross-sectional drawings of a connector that incorporates biasing element 1515, nut 1518, post 116, and body 1512. FIG. 16A shows biasing element 1515 in an unbiased state, while FIG. 16B shows biasing element 1515 in a biased state (e.g., an elongated state). Similar to the description above, nut 1518 may be rotated such that inner threads 154 of nut 1518 engage outer threads 52 of port connector 48 to bring surface 53 of port connector 48 into contact with or near front surface 140 of flange 138 of post 116. In the position shown in FIG. 16A, biasing element 1515 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 118 forward with respect to body 1512 and post 116. As shown in FIG. 16B relative to FIG. 16A, nut 1518 may move a distance d4 in the forward direction relative to body 1512. In this case, rear wall 1510 of nut 1518 may contact forward wall 1584 of biasing element 1515. Likewise, forward wall 1546 of body 1512 may contact rear wall 1586 of biasing element 1515. The displacement of nut 1518 may stretch biasing element 1515 from its rest position (shown in FIG. 16A) to a biased position (shown in FIG. 16B). Biasing element 1515 provides a tension force on nut 1518 in the rearward direction and a tension force on body 1512 in the forward direction.

As biasing element 1515 moves to a biased state, it captures kinetic energy of the rotation of nut 1518 and stores the energy as potential energy. Biasing element 1515 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 1515 may maintain pressure between surface 53 of port 48 and front surface 140 of post 116, which may help maintain electrical continuity and shielding.

Figure 18A:
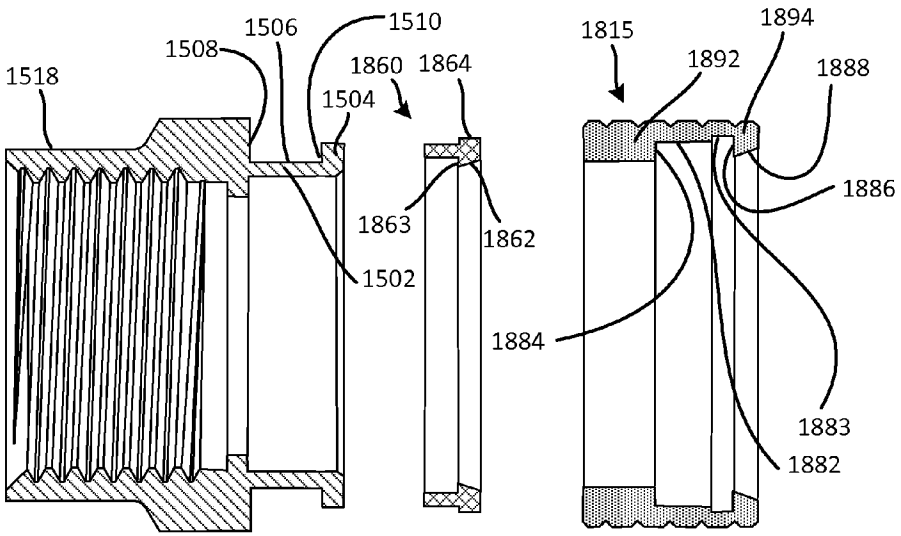
FIG. 18A is a cross-sectional drawing of an exemplary biasing element, nut, and annular ring in another embodiment.

FIG. 18A is a cross-sectional drawing of a biasing element 1815 and nut 1518 in another embodiment. A connector incorporating biasing element 1815 may appear substantially similar to the connector shown in FIG. 17. As shown, biasing element 1815 includes a tubular member having inner and outer surfaces. The inner surface may include an inner recess 1882 having a front wall 1884 and a rear wall 1886. Inner recess 1882 may include an additional recess 1883. The inner surface may also include a rearward facing bevel 1888. The outer surface may include a pattern (e.g., an uneven surface or a knurl pattern) to improve adhesion of biasing element 1815 with an operator's hands. Biasing element 1815 may act as a spring. In this embodiment, FIG. 18A shows biasing element 1815 in its rest state. Any deformation of biasing element 1815 may result in a tension or load force in a direction to return biasing element 1815 to its rest state. Biasing element 1815 may be made from elastomeric material, plastic, metal, or any suitable material or combination of materials. In one embodiment, biasing element 1815, nut 1518, and the connector body are made of a conductive material to enhance conductivity between port connector 48 and post 116. Nut 1518 may is described above with respect to FIG. 15.

Similar to biasing element 1515, biasing element 1815 may be over-molded onto nut 1518. The embodiment of FIG. 18A includes an annular ring 1860. Annular ring 1860 may allow for over-molding without, for example, a collapsible portion for molding the rear portion of biasing element 1815. Annular ring 1860 includes an inner surface and an outer surface. The inner surface includes an inward facing flange 1862 having a beveled rearward edge and a forward facing surface or lip 1863. The outer surface includes an annular flange 1864. Annular ring 1860 may abut nut 1518 (e.g., flange 1504 of annular member 1502) for the over-molding of biasing element 1815 onto nut 1518. Additional recess 1883 may allow for biasing element 1815 to more securely be fastened to annular ring 1860.

Figure 18B:
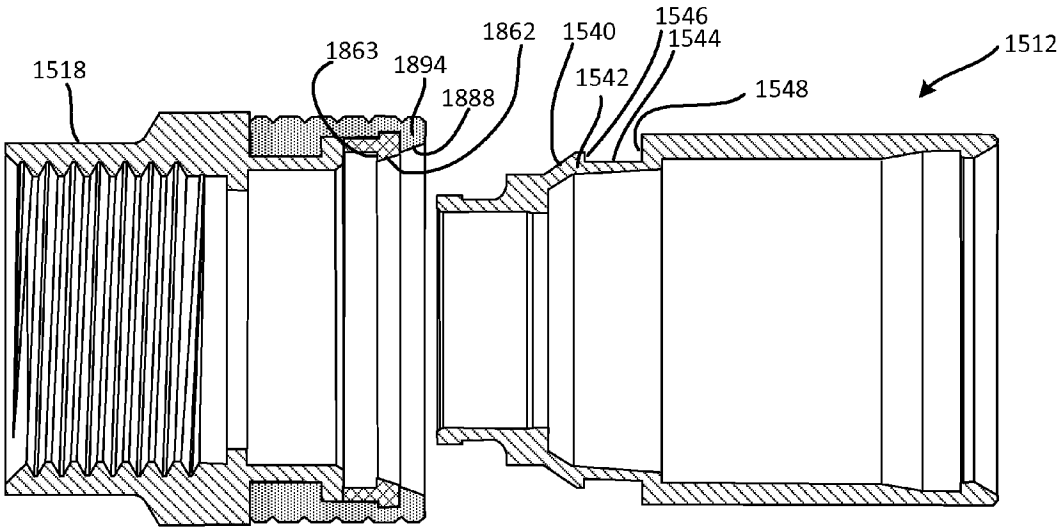
FIG. 18B is a cross-sectional drawing of the nut, biasing element, and annular ring of FIG. 18A, and a connector body, wherein the nut, biasing element, and annular ring are coupled together but not coupled to the connector body.

FIG. 18B is a cross-sectional drawing of connector body 1512, nut 1518, and biasing element 1815. Connector body 1512 shown in FIG. 18B is similar to the connector body described above with respect to FIG. 15B. As shown in FIG. 18B relative to FIG. 18A, recess 1506 of nut 1518 may be used to form forward end 1892 of biasing element 1815. Further, annular flange 1504 of nut 1518 may be used (e.g., in an over-molding process) to form a portion of annular recess 1882 of biasing element 1815, including front wall 1884 of biasing element 1815. The rest of the inner surface of biasing element 1815 (e.g., the remaining portion of recess 1882, rear wall 1886, etc.) may be formed by over-molding biasing element 1815 onto annular ring 1860. In one embodiment, after over-molding biasing element 1815 onto nut 1518 and annular ring 1860, the arrangement of nut 1518, biasing element 1815, and annular ring 1860 may be as shown in FIG. 18B.

Figure 19A:
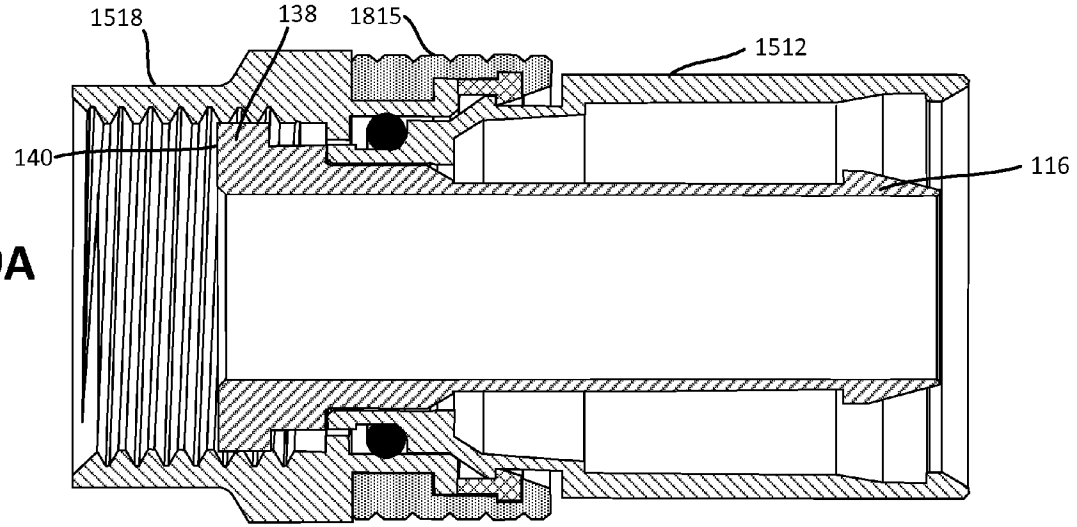
FIG. 19A is a cross-sectional drawing of the biasing element, nut, annular ring, and connector body of FIG. 18B in an assembled configuration, wherein the biasing element is in a rest state.

As shown in FIG. 18B, the angle of bevel 1888 of biasing element 1815 and/or the angle of the bevel of inner flange 1862 of annular ring 1860 may complement the angle of bevel 1540 of body 1512 such that when biasing element 1815 and annular ring 1860 are moved toward body 1512, the inner flange 1862 of annular ring 1860 and rearward portion 1894 of biasing element 1815 may snap over annular portion 1542 and come to rest in annular recess 1544 of body 1512 (as shown in FIG. 19A). The spring nature of biasing element 1815, as described above, may facilitate the movement of rearward portion 1894 over annular portion 1542 of body 1512.

Figure 19B:
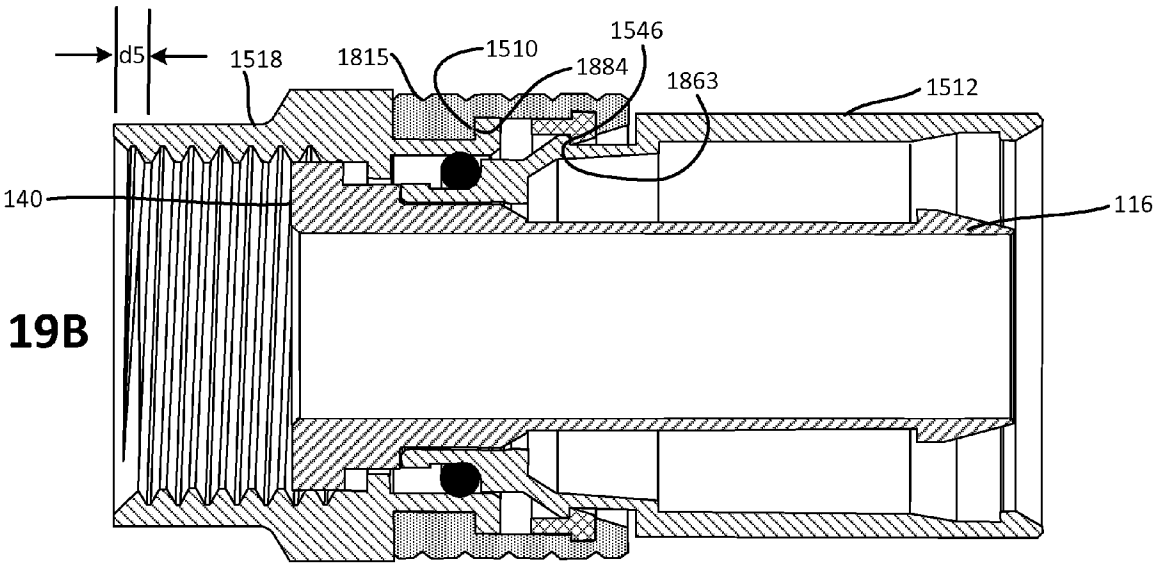
FIG. 19B is a cross-sectional drawing of the biasing element, nut, annular ring, and connector body of FIG. 18B in an assembled configuration, wherein the biasing element is in a biased state.

FIGS. 19A and 19B are cross-sectional drawings of a connector that incorporates biasing element 1815, nut 1518, connector body 1512, and post 116. FIG. 19A shows biasing element 1815 in an unbiased state, while FIG. 19B shows biasing element 1815 in a biased state (e.g., an elongated state). As described above, nut 1518 may be rotated such that inner threads 154 of nut 1518 engage outer threads 52 of port connector 48 to bring surface 53 of port connector 48 into contact with or near front surface 140 of flange 138 of post 116. In the position shown in FIG. 19A, biasing element 1815 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 1518 forward with respect to body 1512 and post 116. As shown in FIG. 19B relative to FIG. 19A, nut 1518 may move a distance d5 in the forward direction relative to body 1512. In this case, rear wall 1510 of nut 1518 may contact forward wall 1884 of biasing element 1815. Likewise, forward wall 1546 of body 1512 may contact lip 1863 of annular member 1860, which is coupled to biasing element 1815. As a result, the displacement of nut 1518 may stretch biasing element 1815 from its rest position (shown in FIG. 19A) to a biased position (shown in FIG. 19B). Biasing element 1815 provides a tension force on nut 1518 in the rearward direction and a tension force on body 1512 in the forward direction.

As biasing element 1815 moves to a biased state, it captures kinetic energy of the rotation of nut 1518 and stores the energy as potential energy. Biasing element 1815 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 1815 may maintain pressure between surface 53 of port 48 and front surface 140 of post 116, which may help maintain electrical continuity and shielding.

Figure 21:
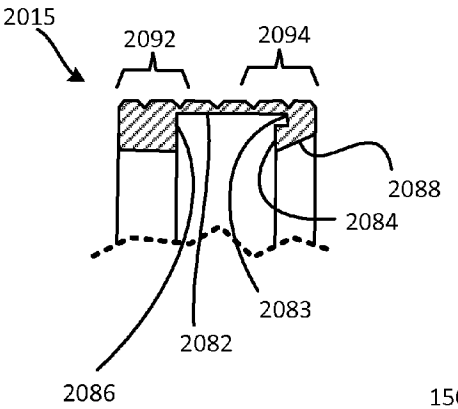
FIG. 21 is a cross-sectional drawing of the exemplary biasing element of the connector shown of FIG. 20.
Figure 20:
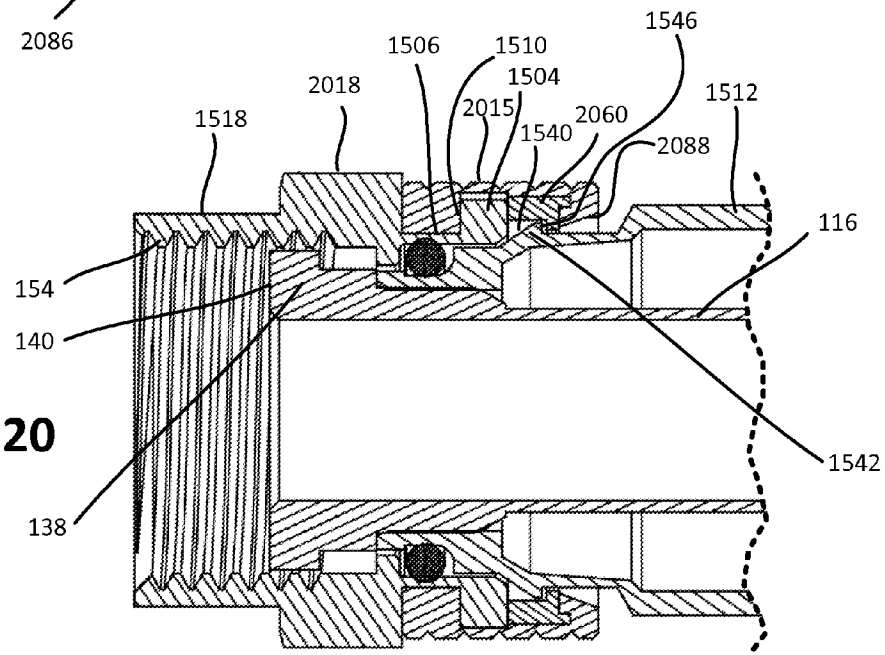
FIG. 20 is a cross-sectional drawing of an exemplary connector including a biasing element in another embodiment.

FIG. 20 is a cross-sectional drawing of a connector including a biasing element 2015 in another embodiment. FIG. 21 is a cross-sectional drawing of a portion of biasing element 2015. A connector incorporating biasing element 2015 may appear substantially similar to the connector shown in FIG. 17. As shown, biasing element 2015 includes a tubular member having inner and outer surfaces. The inner surface may include an inner recess 2082 having a front wall 2084 and a rear wall 2086. Inner recess 2082 may include an additional recess 2083. The inner surface may also include a rearward facing bevel 2088. The outer surface may include a pattern (e.g., an uneven surface or a knurl pattern) to improve adhesion of biasing element 2015 with an operator's hands. Biasing element 2015 may act as a spring. In this embodiment, FIG. 20 shows biasing element 2015 in its rest state. Any deformation of biasing element 2015 may result in a tension or load force in a direction to return biasing element 2015 to its rest state. Biasing element 2015 may be made from elastomeric material, plastic, metal, or any suitable material or combination of materials. In one embodiment, biasing element 2015, nut 1518, and connector body 1512 are made of a conductive material to enhance conductivity between port connector 48 and post 116. Nut 1518, shown in FIG. 20, is similar to nut 1518 described above with respect to FIG. 15.

Figure 22:
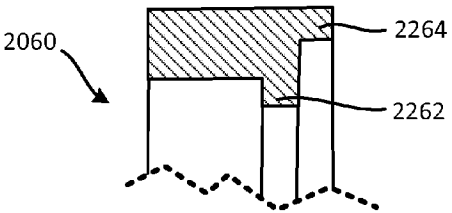
FIG. 22 is a cross-sectional drawing of the exemplary annular ring of the connector shown in FIG. 20.

FIG. 22 is a cross-sectional diagram of annular ring 2060. Similar to biasing element 1815, biasing element 2015 may be over-molded onto nut 1518 and annular ring 2060. Like annular ring 1860, annular ring 2060 may allow for over-molding without, for example, a collapsible portion for molding the rear portion of biasing element 2015. Annular ring 2060 includes an inner surface and an outer surface. The inner surface includes an inner flange 2262 and a rearward flange 2264. Annular ring 2060 may abut nut 1518 for the over-molding of biasing element 2015 onto nut 1518. Rearward flange 2264 may form recess 2083 in biasing element 2015. Additional recess 2083 may allow for biasing element 2015 to more securely be fastened to annular ring 2060. Inward flange 2262 may allow for a better grip by annular member 2060 to body 2018.

Connector body 1512 shown in FIG. 20 is substantially similar to the connector body described above with respect to FIG. 15B. As shown in FIG. 20, recess 1506 of nut 1518 may be used to form forward end 2092 of biasing element 2015. Further, annular flange 1504 of nut 1518 may be used to form a portion of annular recess 2082 of biasing element 2015, including front wall 2086 of recess 2082. The rest of the inner surface of biasing element 2015 (e.g., the remaining portion of recess 2082, rear wall 2084, additional recess 2083, etc.) may be formed by over-molding biasing element 2015 onto annular ring 2060. In one embodiment, after over-molding biasing element 2015 onto nut 1518 and annular ring 2060, the arrangement of nut 1518, biasing element 1515, and annular ring 2060 may be as shown in FIG. 20.

As shown in FIG. 20, the angle of bevel 2088 of biasing element 2015 may complement the angle of bevel 1540 of body 1512 such that when biasing element 2015 and annular ring 2060 are moved toward body 1512, the rear end of annular ring 2060 and rearward portion 2094 of biasing element 2015 may snap over annular portion 1542 and come to rest in annular recess 1544 of body 1512 (as shown in FIG. 20). The spring nature of biasing element 2015, as described above, may facilitate the movement of rearward portion 2094 over annular portion 1542 of body 1512.

As with the connector shown in FIGS. 19A and 19B, nut 1518 in FIG. 20 may be rotated such that inner threads 154 of nut 1518 engage outer threads 52 of port connector 48 to bring surface 53 of port connector 48 into contact with or near front surface 140 of flange 138 of post 116. In the position shown in FIG. 20, biasing element 2015 is in a rest state and not providing any tension force, for example. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 1518 forward with respect to body 1512 and post 116. Nut 1518 may move a distance (not shown) in the forward direction relative to body 1512. In this case, rear wall 1510 of nut 1518 may contact forward wall 2084 of biasing element 2015. Likewise, forward wall 1546 of body 1512 may contact annular ring 2060. The displacement of nut 1518 may stretch biasing element 2015 from its rest position (shown in FIG. 20) to a biased position (not shown), similar to the description above with respect to FIG. 19B. Biasing element 2015 provides a tension force on nut 1518 in the rearward direction and a tension force on body 1512 in the forward direction.

As biasing element 2015 moves to a biased state, it captures kinetic energy of the rotation of nut 1518 and stores the energy as potential energy. Biasing element 2015 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 2015 may maintain pressure between surface 53 of port 48 and front surface 140 of post 116, which may help maintain electrical continuity and shielding.

Figure 23A:
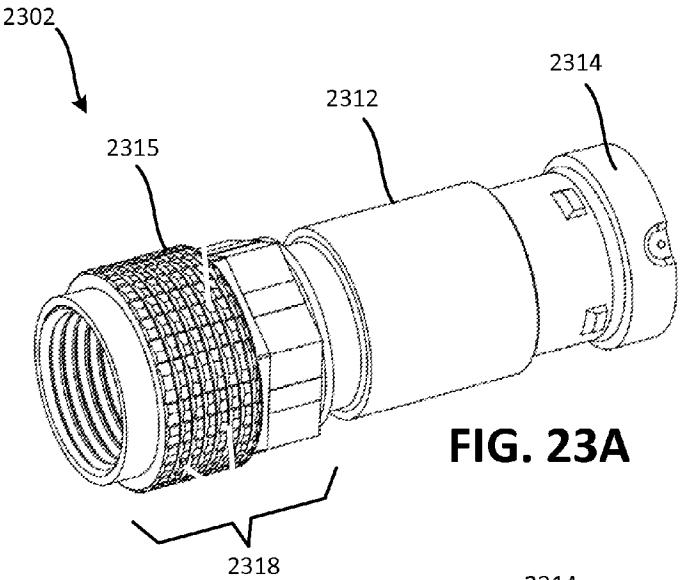
FIG. 23A is a perspective drawing of a connector including a biasing element in another embodiment.
Figure 23B:
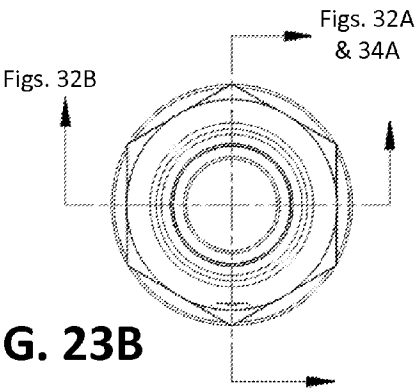
FIG. 23B is a drawing of the front of the connector of FIG. 23A.
Figure 24A:
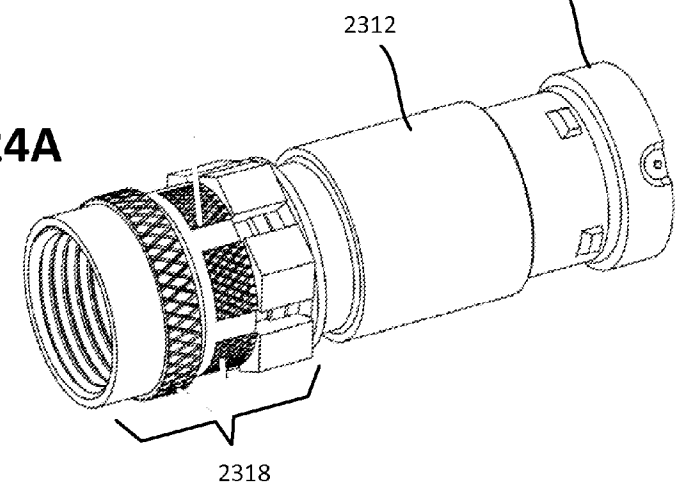
FIG. 24A is a perspective drawing of the connector of FIGS. 23A and 23B without the biasing element.
Figure 24B:
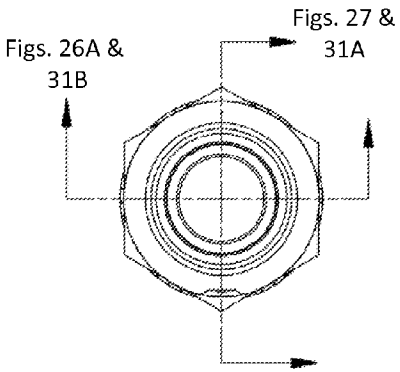
FIG. 24B is a drawing of the front of the connector as shown in FIG. 24A.

FIG. 23A is a perspective drawing of an exemplary connector 2302 in another embodiment. Connector 2302 includes a nut 2318, a biasing element 2315, a connector body 2312, and a locking sleeve 2314. Biasing element 2315, like biasing element 1515, biasing element 915, and biasing element 2015 may include an elastomeric material. For ease of understanding, FIG. 24A is a perspective drawing of connector 2302 without the biasing element 2315.

Figure 25A:
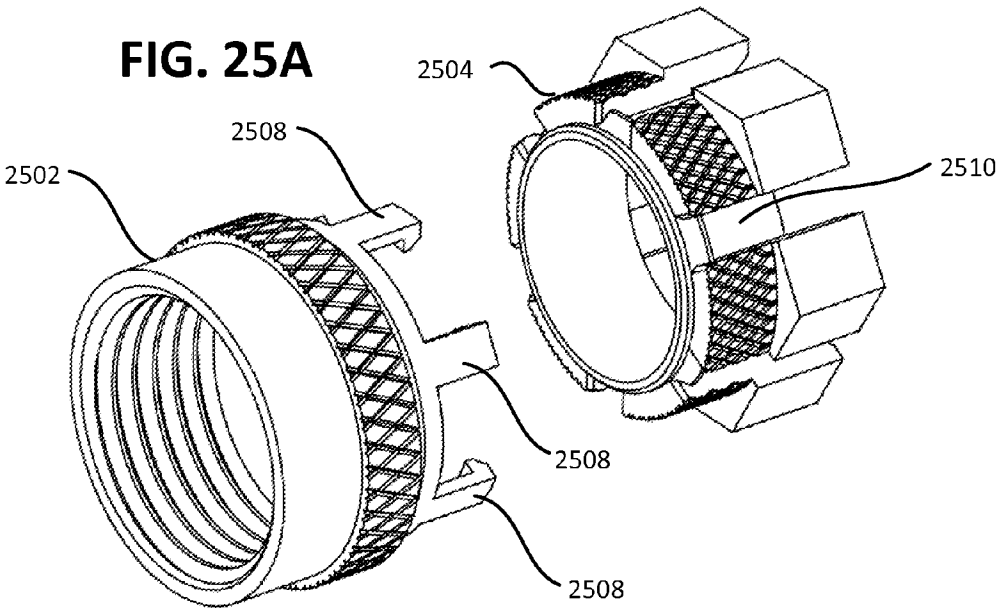
FIG. 25A is a perspective drawing of a front portion and a back portion of the nut of the connector of FIG. 23A, wherein the front portion and the back portion are not coupled together.
Figure 25B:
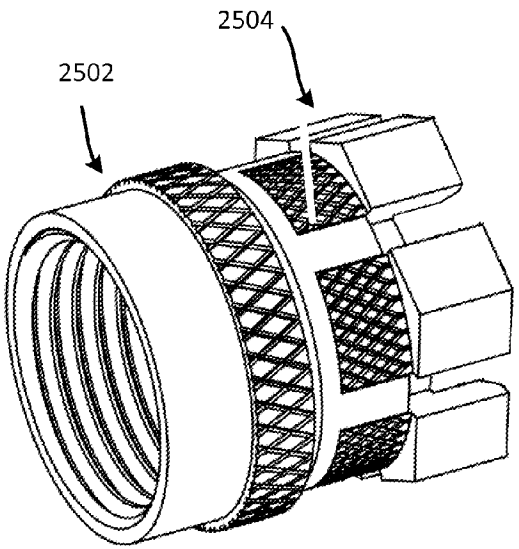
FIG. 25B is a perspective drawing of the back portion and the front portion of the nut of the connector of FIG. 23A, wherein the front portion and the back portion are coupled together.

Nut 2318 of connector 2302 may be formed in two parts, namely a front and a back part. FIG. 25A is a perspective drawing of a front portion 2502 and a rear portion 2504 of nut 2318. Front portion 2502 includes a cylindrical body having inner threads and rearward facing fingers 2508 (individually, "rearward facing finger 2508"). Rear portion 2504 includes a cylindrical body with a plurality of slots 2510 that, in this embodiment, are formed on the outer surface of rear portion 2504. FIG. 25B is a perspective drawing of front portion 2502 and rear portion 2504 coupled together. In the embodiment of FIG. 25B, rearward fingers 2508 fit into slots 2510.

Figure 26A:
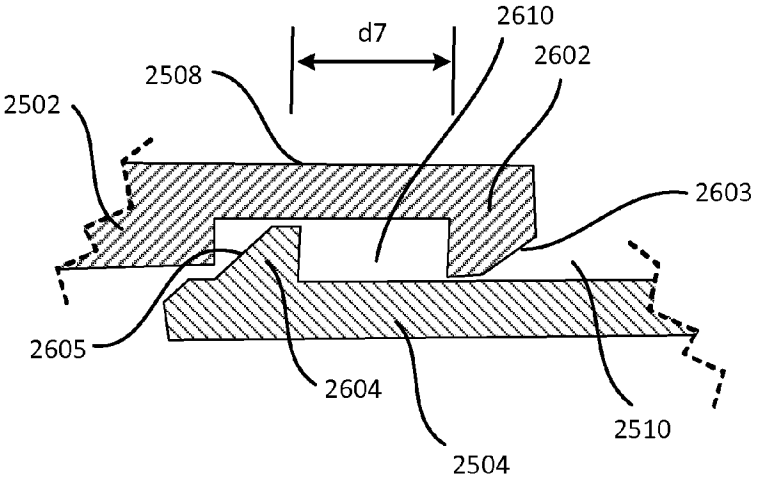
FIGS. 26A and 26B are cross-sectional drawings of the coupling between the front and back portion of the nut as shown in FIG. 25B.
Figure 26B:
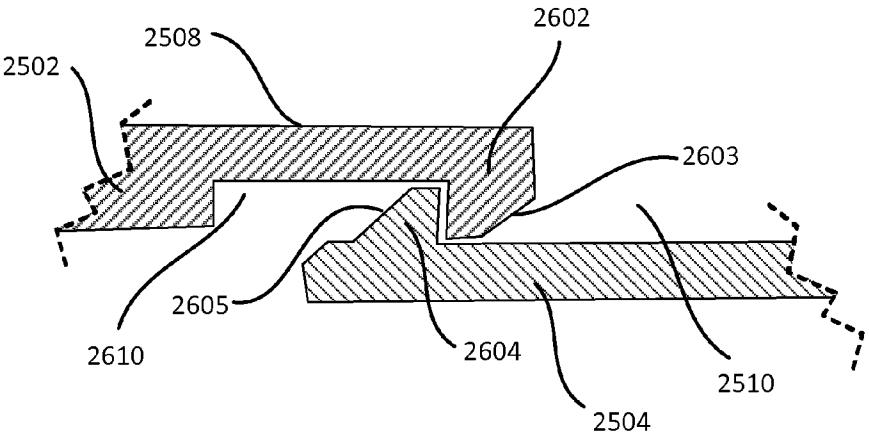

FIG. 26A includes a cross-sectional drawing of rearward facing fingers 2508 of front portion 2502 and rear portion 2504 when front portion 2502 and rear portion 2504 are coupled together, as shown in FIG. 25B. As shown in FIG. 26A, rearward facing finger 2508 includes an inward facing flange 2602 that defines a recess 2610. Inward flange 2602 may include a beveled edge 2603. Rear portion 2504 includes an outward flange 2604 that protrudes from slot 2510 into recess 2610. Outward flange 2604 includes a beveled edge 2605. Beveled edge 2603 of inward flange 2602 (e.g., finger 2508) and beveled edge 2605 of outward flange 2604 (e.g., slot 2510 of rear portion 2504) may complement each other so that when finger 2508 is moved into slot 2510 onto rear portion 2504 (e.g., from the configuration shown in FIG. 25A to the configuration shown in FIG. 25B), finger 2508 will snap over outward flange 2604 into slot 2510 and outward flange 2604 will reside in recess 2610. Once inward flange 2602 of finger 2508 is in slot 2510 and outward flange 2604 is in recess 2610, inward flange 2602 and outward flange 2604 may act to prevent finger 2508 from being removed from slot 2510. Nonetheless, as shown in FIG. 26A, front portion 2502 and rear portion 2504 may be free to move a distance d7 relative to each other. FIG. 26B is a cross-sectional drawing showing front portion 2502 having been moved a distance d7 relative to rear portion 2504 as compared to the components as shown in FIG. 26A.

Figure 27:
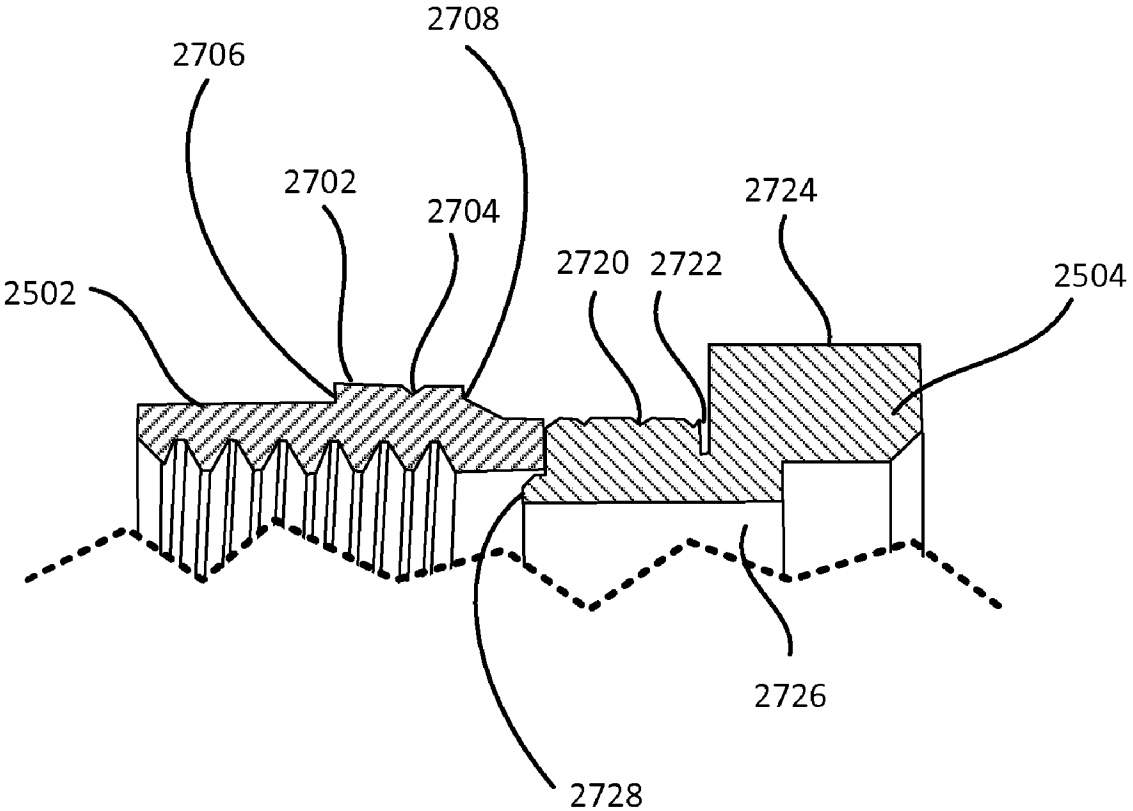
FIG. 27 is a cross-sectional diagram of the coupling between the front and back portion of the nut as shown in FIG. 25B.

FIG. 27 is a cross-sectional drawing of front portion 2502 and rear portion 2504 of nut 2315. Front portion 2502 includes an outer ridge 2702. Outer ridge 2702 includes a pattern 2704 (e.g., an uneven surface or a knurl pattern) for improved adhesion of biasing element 2315 to front portion 2502. Outer ridge 2702 includes a forward edge 2706 and a rearward edge 2708. Edges 2706 and 2708 may also act to improve adhesion of biasing element 2315 to front portion 2502. When forward portion 2502 moves away from rear portion 2504, for example, forward edge 2706 and knurl pattern 2704 may act to stretch (e.g., exert a force on) biasing element 2315 from its rest state to its biased state.

As shown in FIG. 27, rear portion 2504 also includes a knurl pattern 2720 on its outer surface. Knurl pattern 2720 may improve adhesion of biasing element 2315 to rear portion 2504. Rear portion 2504 may also include a recess 2722 for added adhesion of biasing element 2315 to rear portion 2504. Well 2722 may receive biasing element 2315 during the over molding process. Further, rear portion 2504 may include an outer surface 2724 for receiving a tool for tightening nut 2318 onto a port of electronic equipment. Rear portion 2504 may also include an inner surface 2726 with a forward flange 2728. Inner surface 2726 of rear portion 2504 may include a diameter from the center of connector 2302 such that back portion is captured between post 116 and connector body 2312 of connector 2302.

Figure 30:
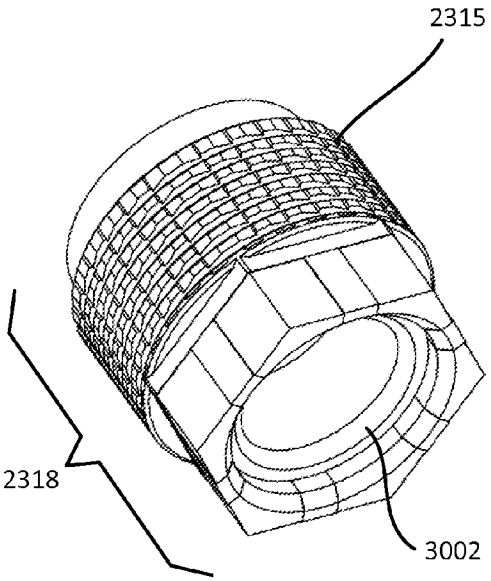
FIGS. 29 and 30 are perspective drawings of the nut of the connector of FIG. 23A including the biasing element.
Figure 28:
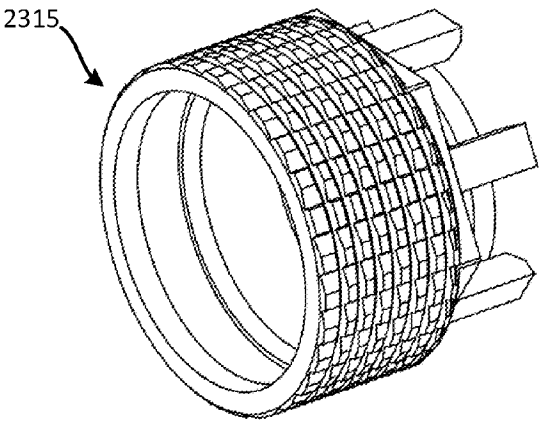
FIG. 28 is a perspective drawing of the biasing element of the connector as shown in FIG. 23A.
Figure 29:
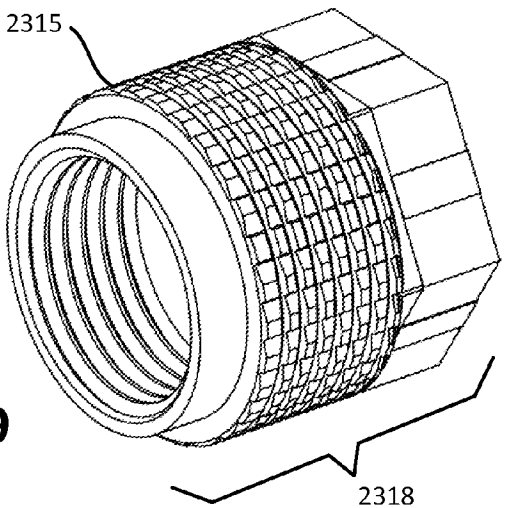

FIG. 28 is a perspective drawing of biasing element 2315. Biasing element 2315 may be molded over front portion 2502 and rear portion 2504. FIG. 29 is a perspective drawing of biasing element 2315 molded over front portion 2502 and rear portion 2504. FIG. 30 is also a perspective drawing of biasing element 2315 molded over front portion 2502 and rear portion 2504, but from the rear perspective. As discussed in more detail below, a portion of biasing element 2315 may also act as a seal 3002.

Figure 31A:
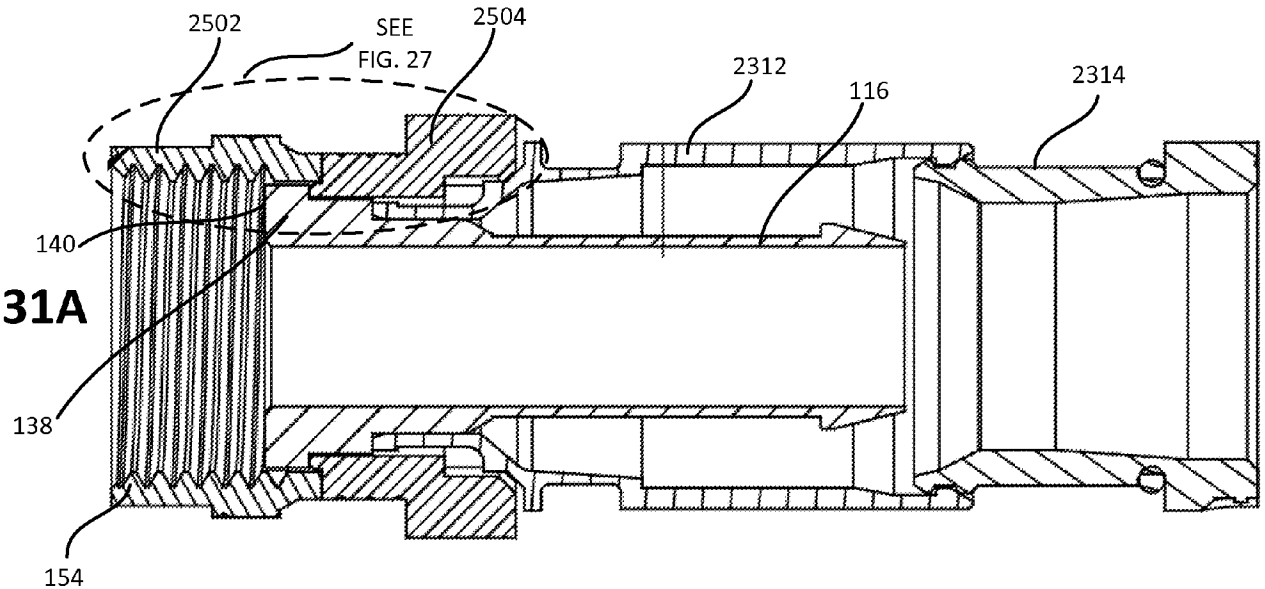
FIGS. 31A and 31B are cross-sectional drawings of the connector of FIG. 23A without the biasing element.
Figure 31B:
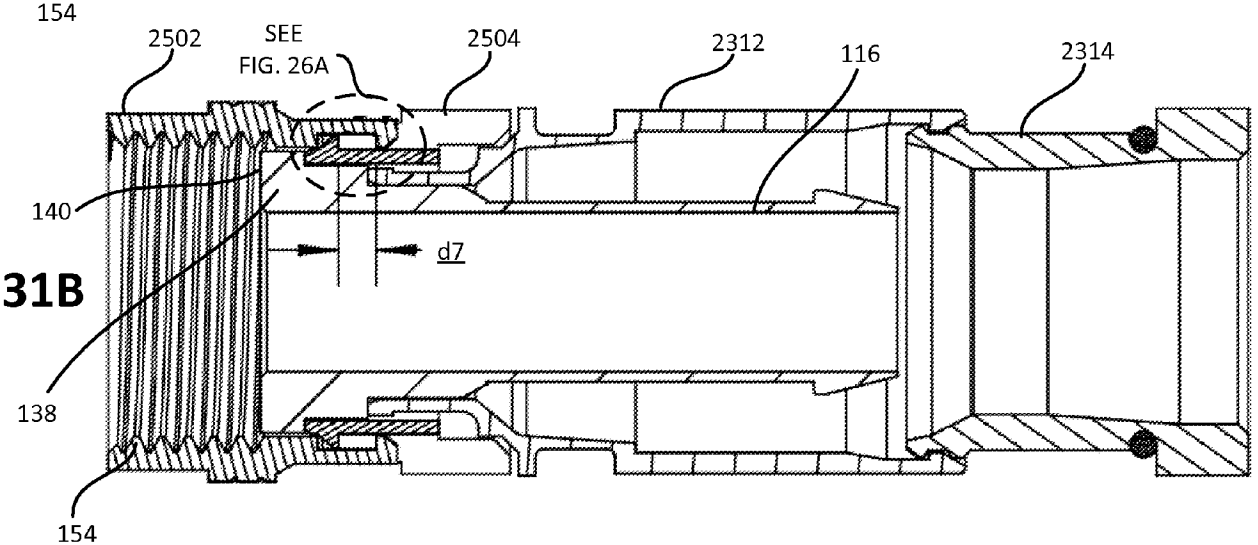

FIG. 31A is a cross-sectional drawing of connector 2302 without biasing element 2315 (see FIG. 24A). As shown in FIG. 31A, post 116 and body 2312 captures rear portion 2504 of nut 2318. FIG. 31B is also a cross-sectional drawing of connector 2302 without biasing element 2315 (with respect to a different plane than FIG. 31A). As shown in FIG. 31B, front portion 2502 of nut 2318 may travel a distance of d7 before rear portion 2504 prevents front portion 2502 from moving further.

Figure 32A:
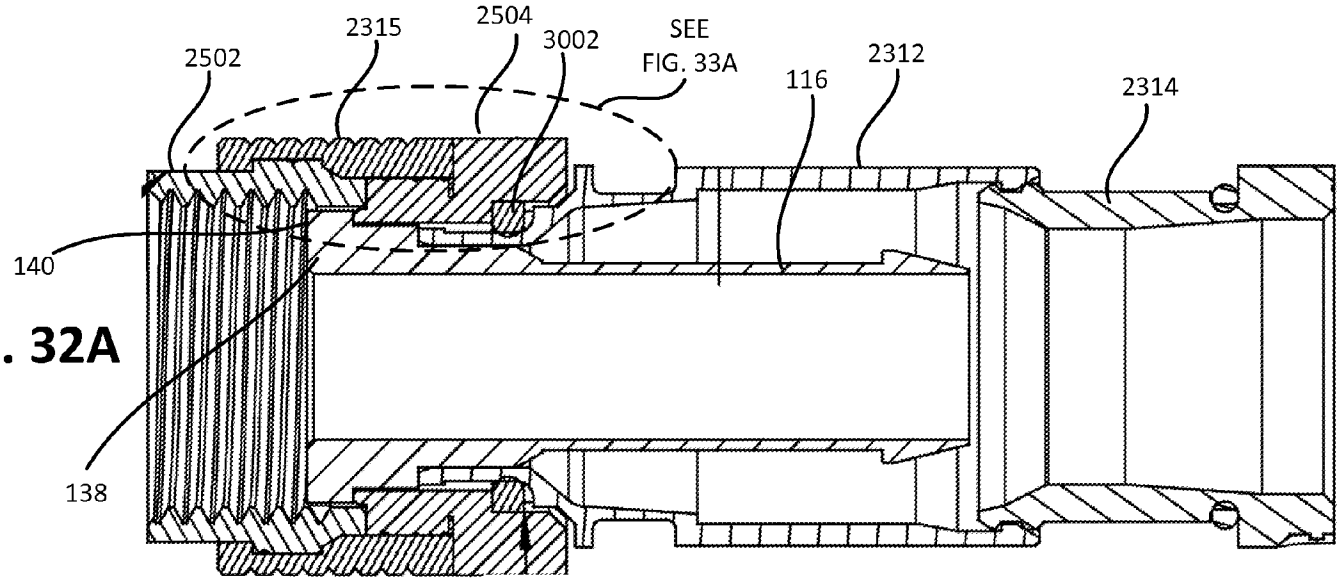
FIGS. 32A and 32B are cross-sectional drawings of the connector of FIG. 23A with the biasing element.
Figure 32B:
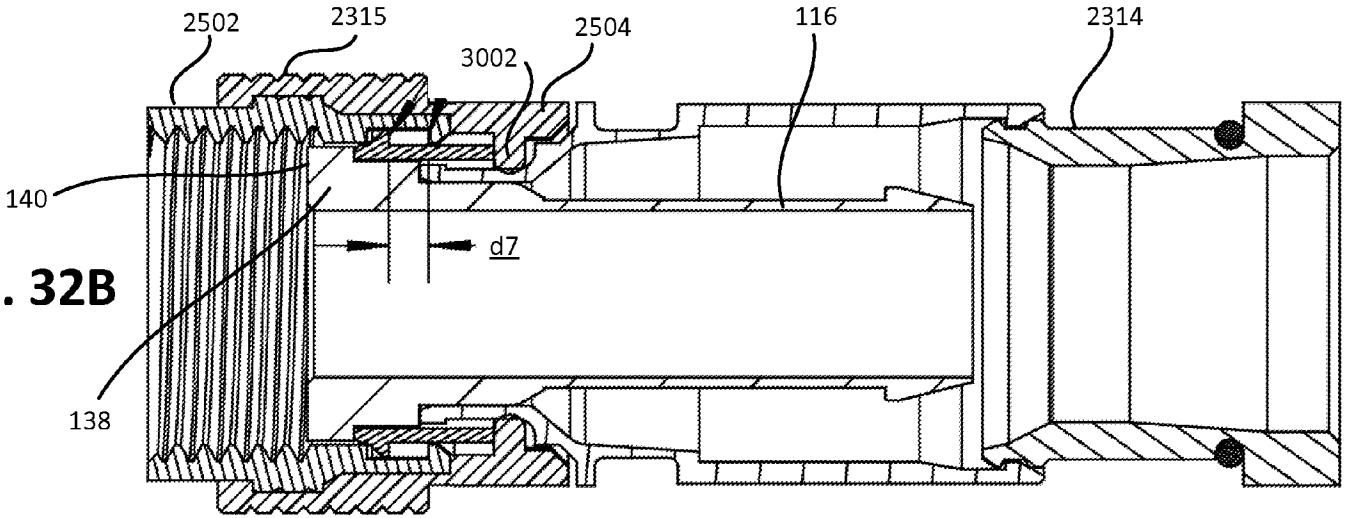

FIG. 32A is a cross-sectional drawing of connector 2302 with biasing element 2315 in a rest state (see FIG. 23A). As shown in FIG. 32A, post 116 and body 2312 captures rear portion 2504 of nut 2318. FIG. 31B is also a cross-sectional drawing of connector 2302 with biasing element 2315 in a rest state (with respect to a different plane than FIG. 32A). As shown in FIG. 32B, a portion of biasing element 2315 may also act as seal 3002. Seal 3002 may keep water and/or other elements from reaching, for example, surface 140 of flange 138 of post 116 so as to help maintain electrical connectivity. As shown in FIG. 32B, front portion 2502 of nut 2318 may travel a distance of d7 before rear portion 2504 prevents front portion 2502 from moving further.

Figure 33:
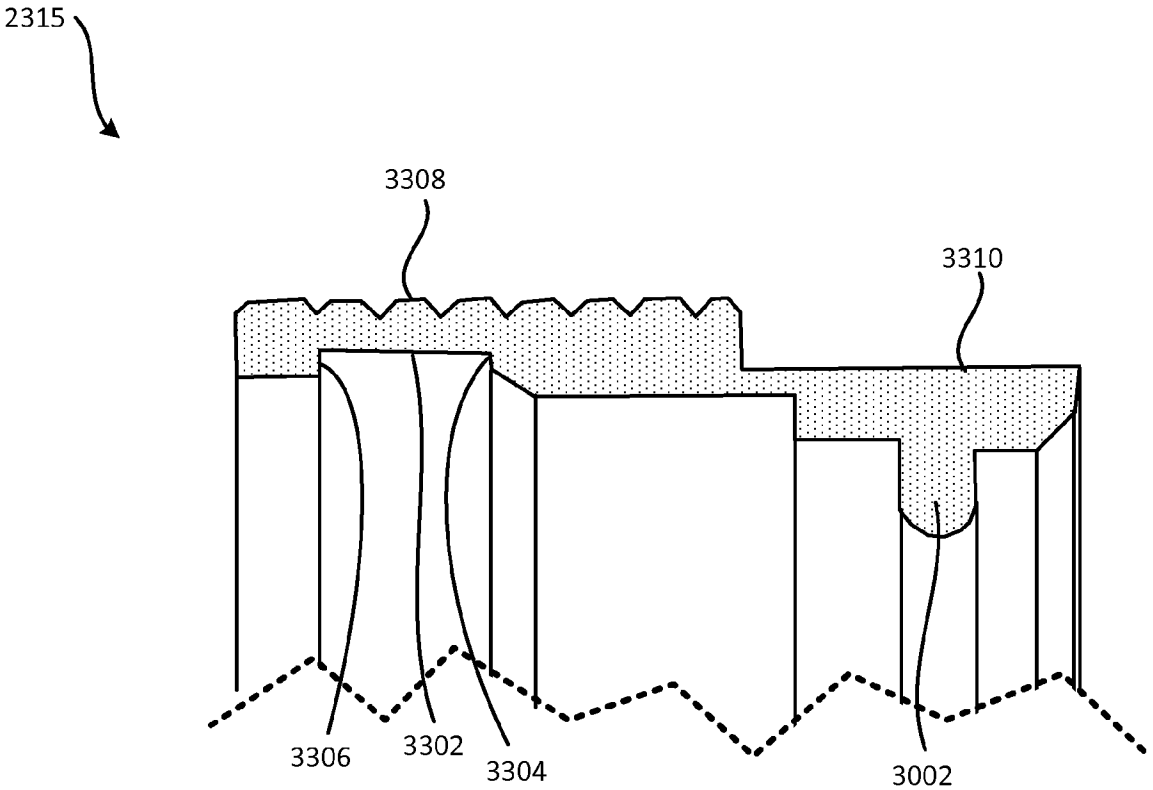
FIG. 33 is a cross-sectional drawing of the biasing element of the connector of FIG. 23A.

FIG. 33 is a cross-sectional drawing of biasing element 2315 as shown in FIG. 32B. Biasing element 2315 includes an inner surface and an outer surface. The outer surface may include a surface 3308 with a pattern (e.g., an uneven surface or a knurl pattern) to improve adhesion of biasing element 2315 with an operator's hands. The outer surface may also include a surface 3310 to allow for a tool to rotate nut 2318. The inner surface includes a recess 3302 having a forward wall 3306 and a rearward wall 3304. Recess 3302, forward wall 3306, and rear wall 3304 may be formed by molding biasing element 2315 over outer ridge 2702 (see FIG. 27). Forward wall 3306 and rearward wall 3304 may also act to improve adhesion of biasing element 2315 to front portion 2502. When front portion 2502 moves away from rear portion 2504, for example, forward edge 3306 may capture edge 2706 of front portion 2502 to stretch (e.g., exert a force on) biasing element 2315 from its rest state to its biased state. Seal 3002 may also be coupled to rear portion 2504, for example, to keep the rear end of biasing element 2315 captured so that when front portion 2502 moves away from rear portion 2504, biasing element is stretched from a rest state to a biased state.

Figure 34A:
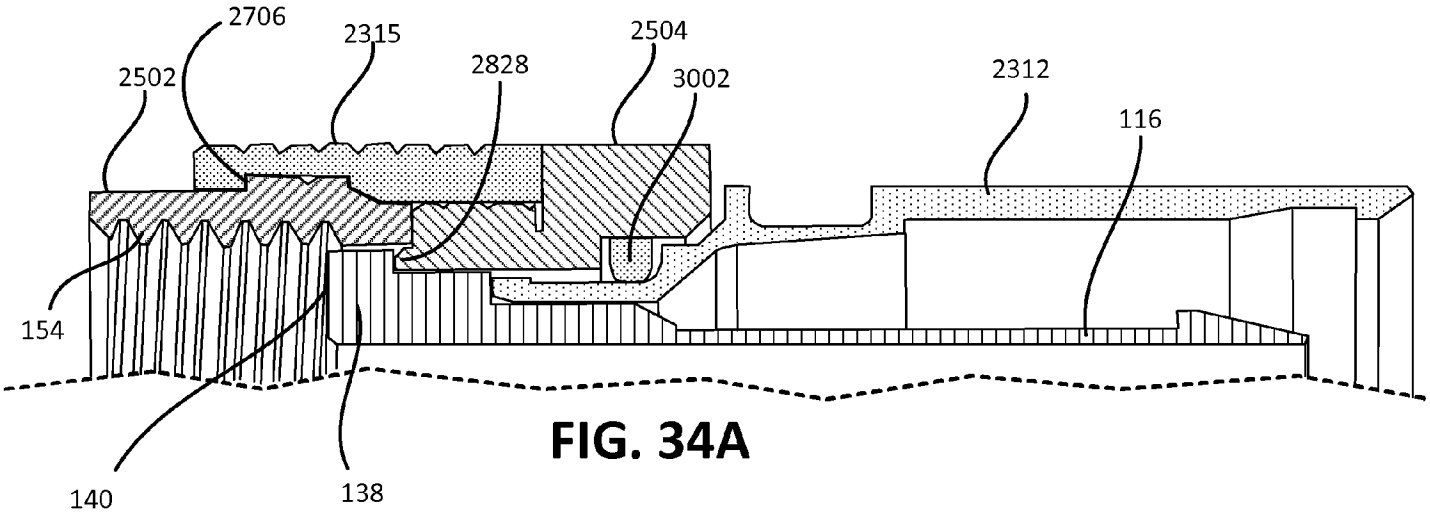
FIGS. 34A and 34B are cross-sectional drawings of the connector of FIGS. 23A and 23B with the biasing element in a rest and a biased state, respectively.
Figure 34B:
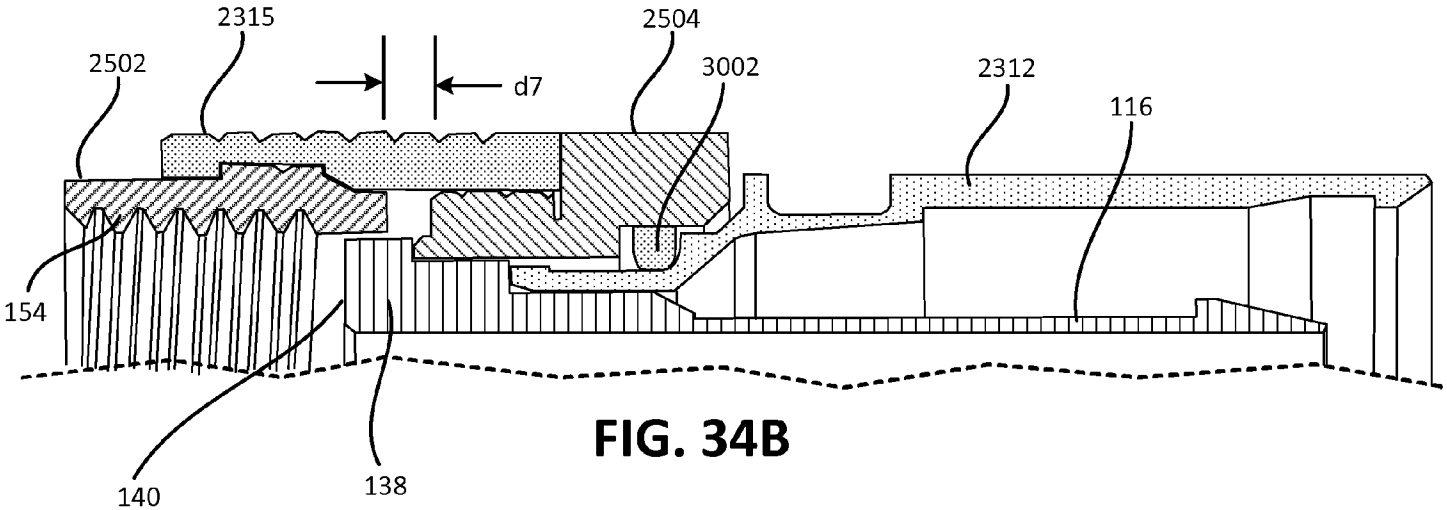

FIG. 34A is a cross-sectional drawing of connector 2302 with biasing element 2315 in a rest position, similar to FIG. 32A. FIG. 34B is a cross-sectional drawing of connector 2302 with biasing element in a biased state after having moved a distance d7. Nut 2318 may be rotated such that the inner threads 154 of nut 2318 engage outer threads 52 of port connector 48 to bring surface 53 of port connector 48 into contact with or near front surface 140 of flange 138 of post 116. In the position shown in FIG. 34A, biasing element 2315 is in a rest state and not providing any tension force, for example. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 2318 may move nut 2318 forward with respect to body 2312 and post 116. Nut 2318 may move a distance d7 in the forward direction relative to body 2312. The displacement of nut 2318 may stretch biasing element 2315 from its rest position (shown in FIG. 34A) to a biased position (shown in FIG. 34B). Biasing element 2015 provides a tension force on front portion 2502 of nut 2318 in the rearward direction and a tension force on body 1512 in the forward direction (by virtue of back portion 2504 butting up against flange 138 of post 116, which is fixed relative to body 2312).

As biasing element 2315 moves to a biased state, it captures kinetic energy of the rotation of nut 2318 and stores the energy as potential energy. Biasing element 2315 provides a load force on front portion 2502 of nut 2318 in the rearward direction and a load force on body 2312 in the forward direction (by virtue of rear portion 2504 butting up against flange 138 of post 116, which is fixed relative to body 2312). These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 2318 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 2315 may maintain pressure between surface 53 of port 48 and front surface 140 of post 116, which may help maintain electrical continuity and shielding.

The foregoing description of exemplary embodiments provides illustration and description, but is not intended to be exhaustive or to limit the embodiments described herein to the precise form disclosed. Modifications and variations are possible in light of the above teachings or may be acquired from practice of the embodiments.

As another example, various features have been mainly described above with respect to a coaxial cables and connectors for securing coaxial cables. In other embodiments, features described herein may be implemented in relation to other types of cable or interface technologies. For example, the coaxial cable connector described herein may be used or usable with various types of coaxial cable, such as 50, 75, or 93 ohm coaxial cable, or other characteristic impedance cable designs.

As discussed above, embodiments disclosed provide for a coaxial connector including a biasing element, wherein the biasing element is configured to provide a force to maintain the electrical path between the mating connector and the coaxial cable. In some embodiments, the biasing element is external to the nut and the connector body (e.g., biasing elements 115, 915, 1215, 1515, 1815, 2015, and 2315). In some embodiments, the biasing element may surround a portion of the nut and a portion of the connector body (e.g., biasing elements 115, 915, 1215, 1515, 1815, 2015, and 2315).

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body;

an annular post disposed within the connector body for providing an electrical path between the mating connector and the coaxial cable; and a biasing element external to the nut and surrounding a portion of the connector body, wherein the biasing element is configured to provide a force to maintain the electrical path between the mating connector and the annular post.

2. The coaxial connector of claim 1, wherein the connector body includes an outwardly protruding flange on the outer surface of the connector body, wherein the nut includes an outwardly protruding flange on the outer surface of the nut, and wherein the biasing element contacts the outwardly protruding flange of the connector body and the outwardly protruding flange of the nut to provide the force.

3. The coaxial connector of claim 2, wherein the biasing element includes an annular portion to support hooks to hook onto the outwardly protruding flange of the nut and the outwardly protruding flange of the connector body.

4. The coaxial connector of claim 3, wherein the hooks include forward-facing hooks and rearward-facing hooks, wherein the forward-facing hooks are configured to snap over the outwardly protruding flange of the nut and the rearward-facing hooks are configured to snap over the outwardly protruding flange of the nut.

5. The coaxial connector of claim 2, wherein the biasing element includes an elastomeric material coupled to the annular flange of the nut and the annular flange of the connector body.

6. The coaxial connector of claim 5, wherein the biasing element is molded over the nut or molded over the connector body.

7. The coaxial connector of claim 5, wherein the biasing element is molded over the nut and an annular ring.

8. The coaxial connector of claim 7, wherein the biasing element is coupled to the flange of the connector body through the annular ring.

9. The coaxial connector of claim 8, wherein the biasing element or annular ring is configured to snap over the outwardly-protruding flange of the connector body.

10. The coaxial connector of claim 5, wherein the biasing element includes an uneven outer surface.

11. The coaxial connector of claim 1, wherein the biasing element provides a force to prevent the nut from backing off the mating connector.

12. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body, wherein the nut includes internal threads for mating to external threads of the mating connector;

an annular post disposed within the connector body for providing an electrical path between the mating connector and the coaxial cable; and a biasing element external to the nut and surrounding a portion of the connector body, wherein the biasing element is configured to provide a force to maintain tension between the internal threads of the nut and the external threads of the mating connector.

13. The coaxial cable connector of claim 12, wherein the nut includes a forward portion and a rear portion, wherein the forward portion and rear portion are configured to move relative to each other along an axial direction.

14. The coaxial connector of claim 13, wherein the rear portion of the nut is rotatably captured between the connector body and a flange of the post, and wherein the rear portion of the nut includes a recess, and wherein the front portion of the nut includes an outwardly protruding flange on the outer surface of the front portion of the nut.

15. The coaxial connector of claim 14, wherein the biasing element is coupled to the outwardly protruding flange of the front portion of the nut and the recess of the rear portion of the nut.

16. The coaxial connector of claim 14, wherein the biasing element is an elastomeric material molded over the front portion of the nut and the rear portion of the nut.

17. The coaxial connector of claim 16, wherein the elastomeric material forms a sealing element between the connector body and the rear portion of the nut.

18. The coaxial connector of claim 14, wherein the front portion of the nut includes an inwardly facing flange and the rear portion of the nut includes an outwardly facing flange, wherein the inwardly facing flange and the outwardly facing flange abut to prevent the front portion of the nut and the rear portion of the nut from moving in the axial direction away from each other.

19. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body, wherein the nut includes internal threads for mating to external threads of the mating connector;

an annular post disposed within the connector body for providing an electrical path between the mating connector and the coaxial cable; and a biasing element external to the nut, wherein the biasing element is configured to provide a force to maintain electrical contact between the post and the mating connector.

20. The coaxial cable connector of claim 19, wherein the biasing element includes elastomeric material.

21. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body;

an annular post disposed within the connector body for providing an electrical path between the mating connector and the coaxial cable; and an elastomeric biasing element external to the nut and surrounding a portion of the connector body, wherein the biasing element is configured to provide a force to maintain the electrical path between the mating connector and the annular post.

* * * * *